US010207130B2

(12) United States Patent
Cooper et al.

(10) Patent No.: US 10,207,130 B2
(45) Date of Patent: Feb. 19, 2019

(54) FAST ROPE INSERTION SYSTEM

(71) Applicant: The United States of America, as represented by the Secretary of the Air Force, Washington, DC (US)

(72) Inventors: Cory Alan Cooper, Monument, CO (US); Darren Craig Tidwell, Huntsville, UT (US); Garrett Fritzsche, Monument, CO (US); Christopher Yooshin Jang, Colorado Springs, CO (US); Brock M. Flieger, Colorado Springs, CO (US); Alan James Vaillencourt, Jr., Cookeville, TN (US); Miranda Leigh Bray, Colorado Springs, CO (US); Shane Michael Riley, Sheppard AFB, TX (US); Nathanael Jordan Szuch, SAFB, TX (US); Philip T. Strunk, USAF Academy, CO (US)

(73) Assignee: United States of America as represented by the Secretary of the Air Force, Washington, DC (US)

( * ) Notice: Subject to any disclaimer, the term of this patent is extended or adjusted under 35 U.S.C. 154(b) by 16 days.

(21) Appl. No.: 15/494,699

(22) Filed: Apr. 24, 2017

(65) Prior Publication Data

US 2018/0304103 A1 Oct. 25, 2018

(51) Int. Cl.

*A62B 35/00* (2006.01)
*A62B 1/06* (2006.01)
(Continued)

(52) U.S. Cl.

CPC ..... *A62B 35/0075* (2013.01); *A62B 1/06* (2013.01); *A62B 1/10* (2013.01); *A62B 1/14* (2013.01);
(Continued)

(58) Field of Classification Search

CPC ..... A62B 1/06; A62B 1/14; A62B 35/0037; A62B 35/0075; A62B 35/0025; A62B 35/04

See application file for complete search history.

(56) References Cited

U.S. PATENT DOCUMENTS 31,946 A 4/1861 Beagle, Jr.
57,456 A 8/1866 Alyson
(Continued)

FOREIGN PATENT DOCUMENTS

CA 2415874 7/2004
CN 100343154 10/2007
(Continued)

OTHER PUBLICATIONS

DE3347725 machine translation.
DE3037766 machine translation.
CN100343154 machine translation.

*Primary Examiner* — Colleen M Chavchavadze
(74) *Attorney, Agent, or Firm* — AFMCLC/JAZ; Timothy Barlow

(57) ABSTRACT

A user insertion system, that includes (a) a belay tether connectable to a support and configurable for descending a user; (b) an attachment device installable onto the support between the support and the belay tether; (c) a user braking device connectable between the belay tether and the user; and (d) a tip resistant system.

9 Claims, 20 Drawing Sheets

(51) Int. Cl.

| | |
|---|---|
| ***A63B 29/00*** | (2006.01) |
| ***A62B 1/10*** | (2006.01) |
| ***A62B 1/14*** | (2006.01) |
| *A62B 35/04* | (2006.01) |

(52) U.S. Cl.
CPC ..... *A62B 35/0037* (2013.01); *A63B 29/00* (2013.01); *A62B 35/04* (2013.01)

(56) References Cited

U.S. PATENT DOCUMENTS 184,211 A 11/1876 Jones
217,942 A 7/1879 Hayden
340,558 A * 4/1886 Converse ..... F16B 45/06 24/598.5
346,811 A * 8/1886 Drew ..... F16B 45/06 24/598.5
487,135 A * 11/1892 Stott ..... A62B 1/14 188/65.3
506,707 A * 10/1893 Matts ..... A62B 1/14 188/65.3
550,189 A * 11/1895 Melks ..... F16B 45/06 24/598.5
579,823 A * 3/1897 Forbes ..... A62B 1/14 182/7
586,173 A * 7/1897 Frahm ..... A62B 1/14 182/193
588,889 A * 8/1897 Wabnitz ..... A62B 1/14 182/192
613,764 A * 11/1898 Hansen ..... A62B 1/14 182/7
641,316 A 1/1900 Meyer
682,684 A 9/1901 Hakemeyer
702,858 A * 6/1902 Hendricks ..... A62B 35/0025 182/6
755,841 A 3/1904 Brady
1,041,399 A 10/1912 Adams
1,059,754 A * 4/1913 Paquet ..... A62B 1/14 182/193
1,190,389 A * 7/1916 Erwin ..... A62B 1/14 182/193
1,372,853 A * 3/1921 Wellen ..... A62B 1/14 188/65.2
1,392,184 A 9/1921 Long
1,470,746 A * 10/1923 Johnson ..... A62B 1/06 182/191
16,587,087 1/1928 Johnston et al.
1,671,527 A * 5/1928 Jones ..... A62B 1/14 182/7
1,766,566 A * 6/1930 Tucker ..... A62B 1/14 182/100
2,211,273 A 8/1940 Kleckner
2,585,876 A * 2/1952 Thoennes ..... A62B 1/06 182/236
2,674,773 A 4/1954 Lundholm
2,979,028 A * 4/1961 Zakely ..... A62B 35/0018 182/3
3,437,178 A * 4/1969 Postlethwait ..... A62B 1/14 182/5
3,701,395 A * 10/1972 Theobald ..... A62B 35/0018 128/845
3,703,218 A * 11/1972 Brda ..... A62B 1/14 182/13
3,717,219 A * 2/1973 Hoffman ..... A62B 1/14 182/135
3,799,287 A * 3/1974 Ledner ..... A62B 1/14 182/5
3,826,341 A * 7/1974 Ledner ..... A62B 1/14 182/5
3,841,666 A 10/1974 Gaylord
3,869,021 A * 3/1975 Sutherland ..... A62B 35/0018 182/135
3,938,620 A * 2/1976 Nothiger ..... A62B 1/14 182/135
3,956,804 A * 5/1976 Gatof ..... A44C 5/2038 24/598.5
4,054,183 A * 10/1977 Boniface ..... A62B 1/14 182/142
4,106,589 A * 8/1978 Petersen ..... A62B 1/06 182/5
4,347,914 A * 9/1982 Gary ..... A45F 3/26 182/142
4,399,889 A * 8/1983 Todd ..... A62B 1/14 182/193
4,494,629 A * 1/1985 Raeburn ..... A62B 1/14 182/7
4,515,240 A * 5/1985 Curtis ..... A62B 1/14 182/6
4,598,792 A * 7/1986 Lew ..... A62B 1/00 182/42
4,632,218 A * 12/1986 Hannan ..... A62B 1/14 182/5
4,645,033 A * 2/1987 Oelschlager ..... A62B 35/0037 182/6
4,645,034 A * 2/1987 Griffith ..... A62B 35/04 182/231
4,662,475 A * 5/1987 Rutschi ..... A62B 1/14 182/192
4,722,495 A 2/1988 Meredith
4,911,394 A * 3/1990 Ericson ..... B66C 1/34 248/301
5,005,266 A 4/1991 Fister et al.
5,056,619 A * 10/1991 Darnell ..... A62B 1/06 182/191
5,058,706 A * 10/1991 Pai ..... A62B 1/14 182/5
5,107,956 A * 4/1992 Constantinis ..... A62B 1/06 182/5
5,127,490 A * 7/1992 Sheu ..... A62B 1/10 182/236
5,145,028 A * 9/1992 Wai ..... A62B 1/10 182/193
5,360,083 A 11/1994 Hede
5,487,444 A * 1/1996 Dennington ..... A62B 35/04 182/6
6,390,234 B1 * 5/2002 Boyer ..... A62B 35/0018 182/3
6,698,544 B2 3/2004 Kurtgis
8,584,799 B1 * 11/2013 Dennington ..... A62B 35/04 182/3
9,162,089 B2 * 10/2015 Harshbarger ..... A62B 35/00
9,242,736 B2 1/2016 Fitzgerald
9,308,402 B2 * 4/2016 Chevalier ..... A62B 35/00
9,486,655 B1 * 11/2016 London, Sr. ..... A62B 35/0018
9,943,710 B1 * 4/2018 Cooper ..... A63B 29/00
2009/0071750 A1 * 3/2009 Simard ..... A62B 1/14 182/5

FOREIGN PATENT DOCUMENTS

DE 3037766 10/1980
DE 3347725 12/1983
WO 20140088603 6/2014

* cited by examiner

FAST ROPE INSERTION SYSTEM

GOVERNMENT INTEREST

The invention described herein may be manufactured and used by or for the Government of the United States for all governmental purposes without the payment of any royalty.

CROSS REFERENCE TO RELATED APPLICATIONS

Pursuant to 37 C.F.R. § 1.78(d)(1), this application claims the benefit of and priority to prior filed co-pending Non-Provisional application Ser. No. 15/487,833, filed 14 Apr. 2017, and co-pending Non-Provisional application Ser. No. 15/489,116, filed 17 Apr. 2017, which are expressly incorporated herein by reference.

FIELD OF THE INVENTION

This invention relates to the field of tethered systems. More particularly, this invention relates to a tethered systems that include one or more of the following: (a) a belay tether connectable to a support and configurable for descending a user; (b) an attachment device installable onto the support between the support and the belay tether; (c) a user braking device connectable between the belay tether and the user; and (d) a tip resistant system.

BACKGROUND OF THE INVENTION

Improvement is desired in the construction of devices used for descending users from elevated locations or ascending users to elevated locations. Conventional devices have numerous shortcomings, and the improvement of such devices is desired for use in the sport of rock climbing, as well as for use in first responder and military environments.

For example, a belay tether may be connected in some form or fashion to an elevated support, such as a tower, a helicopter or other support. Often, two hands are required to make the necessary connection between the load and the structure associated with the support location. Additionally, users are often required to lift and hold all or a portion of the load, which may be quite heavy, while the connection is being made. This is often carried out in positions and locations that involve potential danger and that require significant effort and dexterity. This shortcoming represents one aspect in which improvement is desired.

The user also typically wears a body harness and a device is utilized to connect between the body harness and the belay tether. Conventionally, the user must grasp the belay tether with one or both hands to balance and resist tipping backwards to remain in a generally upright attitude during descent (or ascent) and upon landing. This can become difficult in certain environments, and especially when the user has a backpack or other equipment, such as body armor, tools, or like equipment carried by the user. This represents yet another aspect in which improvement is desired.

In addition, in many instances, the belay tether is associated with an automatic belaying device, which enables controlled descent. However, there is currently no way for the user to slow or halt the descent, as the belay device continues to feed out the belay tether. This represents a further aspect in which improvement is desired.

FIG. 1 illustrates a prior art system for tethered descent of a user U from a support S. A conventional automatic belay device BD is connected to the support S by a support tether ST connected by a pair of conventional snap rings SR. It is often difficult with such a configuration for the user U to quickly form a connection between the support S location and the belay device BD with limited engagement by the user U, such as through the use of one hand, as may be required in a variety of situations and conditions.

As also seen, a prior art harness connector HC connects between a belay tether BT of a belay device BD, and a body harness BH worn by the user. Conventionally, the user U grasps the belay tether BT with one or both hands to balance and resist tipping backwards to remain in a generally upright attitude during descent (or ascent) and upon landing. This can become difficult in certain environments, and especially when the user has a backpack BP or other equipment, such as body armor, tools, or like equipment carried by the user. FIG. 1 depicts one of the problems associated with conventional devices, characterized by the user U tipping backwards and being unable to maintain a desired upright attitude, especially when wearing the backpack BP or other equipment.

In addition, it can be difficult for the user to detach from the belay tether BT when landing. FIG. 1 also shows use of a conventional snap ring SR to connect between the harness connector HC and the belay tether BT. The snap ring SR and similarly configured fastener devices are difficult to operate, especially when the user has only one hand to operate the device, is attempting to operate the device in an urgent situation, or is operating in an environment characterized by a variety of difficult conditions.

Finally, it will be observed that while the belay device BD is an automatic belaying device, which enables controlled descent, the user U has no way to slow or halt the descent, as the belay device continues to feed out the belay tether.

To address the foregoing shortcomings of the prior art, one aspect of the present invention relates to an attachment device for quick engagement with a support that enables the user to quickly form a connection between a support location and the load with limited engagement by the user, such as through the use of one hand, as may be required in a variety of situations and conditions.

Another aspect of the invention relates to a tip resistant system that operates to maintain a user in a desired static attitude. The tip resistant system may also incorporate a quick disconnect feature that enables the user to quickly disconnect from the belay tether with limited engagement by the user, such as through the use of one hand, as may be required in a variety of situations and conditions.

Further, in accordance with another aspect, the invention relates to user-controllable belay and braking systems suitable for enabling a user to control and even halt descent from a support from which the user is descending.

SUMMARY OF THE INVENTION

The above and other needs are met by a user insertion system, that includes (a) a belay tether connectable to a support and configurable for descending a user; (b) an attachment device installable onto the support between the support and the belay tether; (c) a user braking device connectable between the belay tether and the user; and (d) a tip resistant system.

The attachment device (b) includes a pair hooks rotatably mounted to the support so as to be oppositely facing and laterally offset from one another, a stop defined on one of the hooks and located so that the other one of the hooks is prevented from rotating past the stop by contact with the stop, and a biasing member operatively associated with the hooks for urging the hooks to rotate toward one another and until engaging the stop, which limits rotation of the hooks to maintain the hooks relative to one another to facilitate installation of the attachment device onto the support.

The user braking device (c) includes a rigid body configured to be connectable between the user and the belay tether, a pulley positioned on the rigid body and configured for receiving the belay tether when the braking system is in use, a brake member yieldably positioned adjacent the pulley, a brake bias member operatively associated with the brake member to bias the brake member away from the pulley, and a lever pivotally connected to the rigid body and operable by the user to bear against the brake member to controllably overcome the first bias member and controllably bear the brake member toward the pulley.

The tip resistant system (d) includes a user tether having a first length and configured to be connectable between the user and the belay tether, the user tether having a belay tether connector adjacent one end of the user tether, and a user connector adjacent an opposite end of the user tether, and an auxiliary tether having a second length less than the first length of the user tether and configured to be connectable between the user and the user tether, the auxiliary tether including: a user tether connector located adjacent a first end of the auxiliary tether, and an auxiliary user connector located adjacent a second end of the auxiliary tether opposite the user tether connector. The tip resistant system operates to maintain a user in a desired static attitude.

Other aspects of the invention relate to user insertion systems having various combinations of the attachment device (b), the user braking device (c), and the tip resistant system (d).

BRIEF DESCRIPTION OF THE DRAWINGS

Other embodiments of the invention will become apparent by reference to the detailed description in conjunction with the figures, wherein elements are not to scale so as to more clearly show the details, wherein like reference numbers indicate like elements throughout the several views, and wherein.

DETAILED DESCRIPTION OF THE INVENTION

Figure 1:
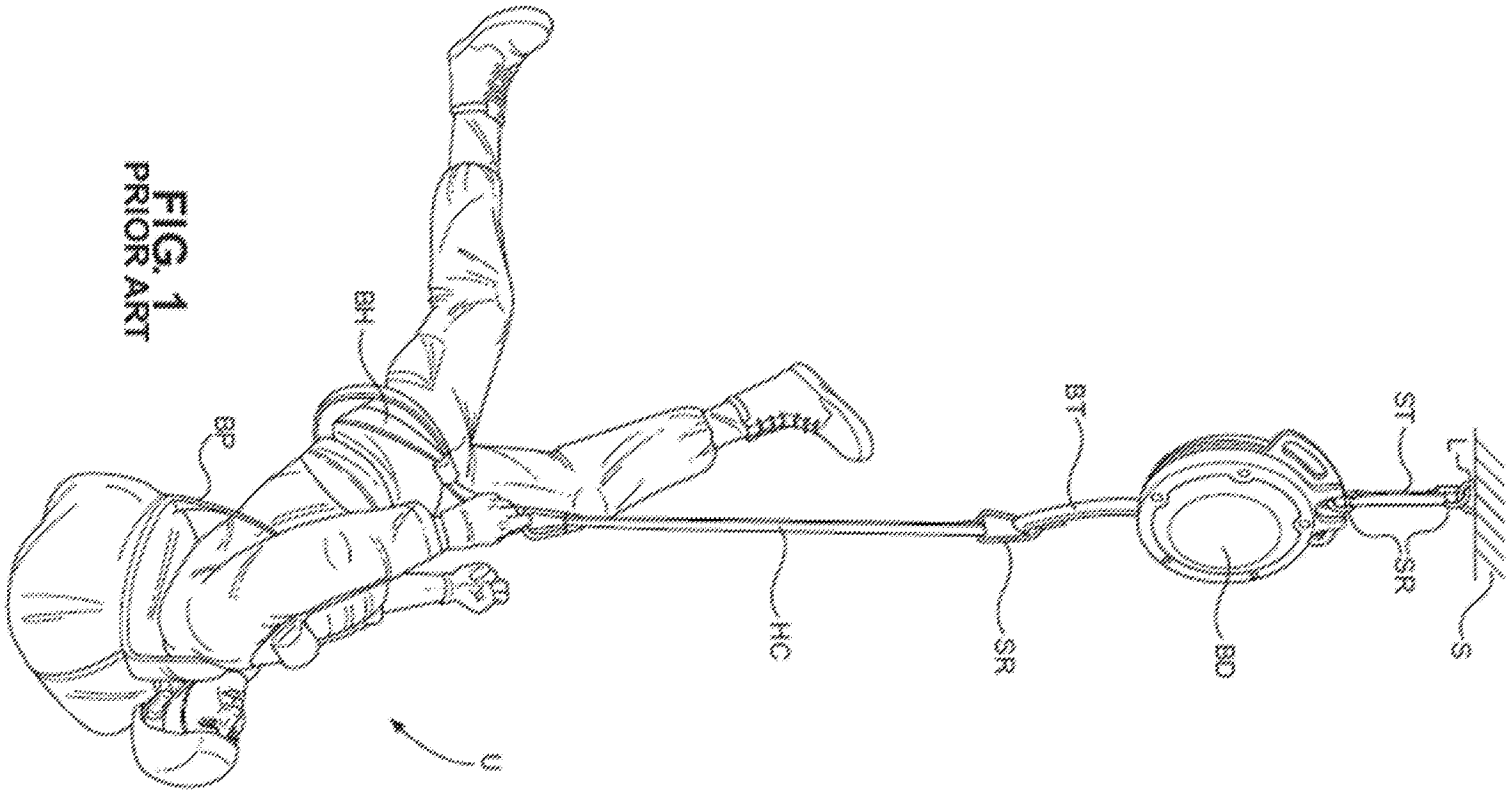
FIG. 1 PRIOR ART
FIG. 1 depicts prior art devices used for descending users from elevated locations.
Figure 2:
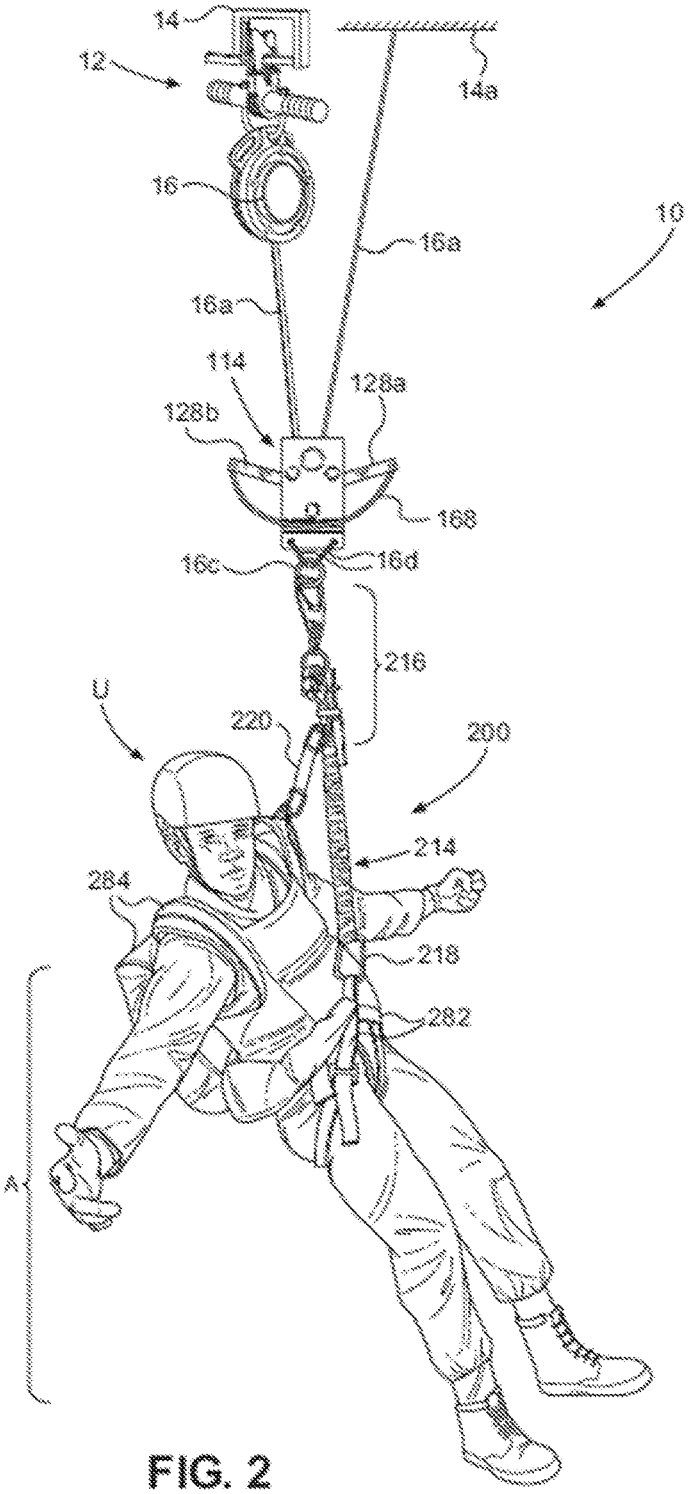
FIGS. 2 and 3 depict a user insertion system according to the invention configured to overcome many of the shortcomings of the prior art devices of FIG. 1.
Figure 3:
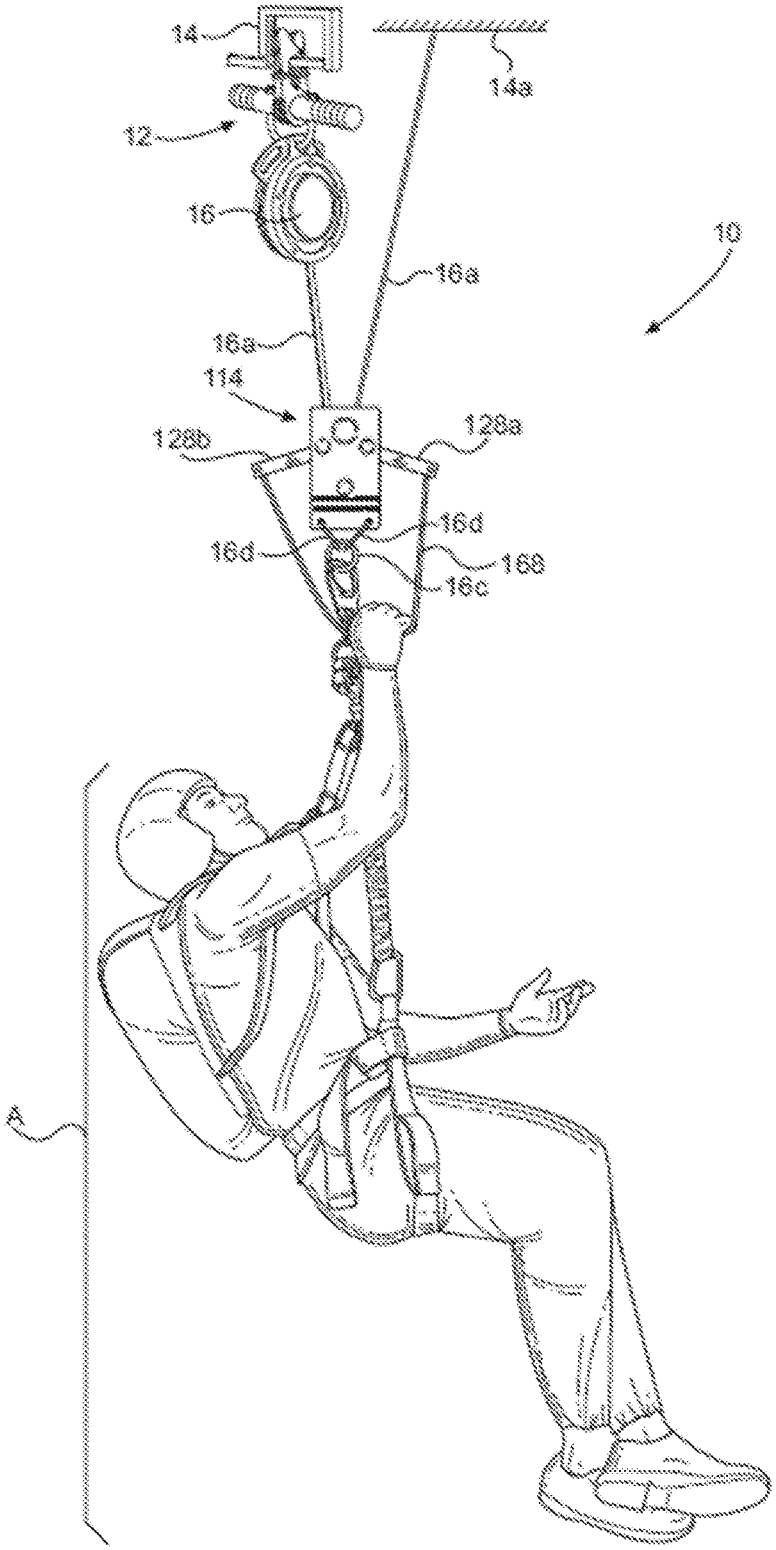

With initial reference to FIGS. 2 and 3, there is shown a user insertion system 10 configured to overcome many of the shortcomings of prior art devices.

The insertion system 10 includes, as major components, a push locking load attachment device 12, a user controllable braking system 114, and a tip resistant system 200.

In brief overview, the push locking load attachment device 12 enables quick engagement with a support that enables the user to quickly form a connection between a support and the load with limited engagement by the user, such as through the use of one hand, as may be required in a variety of situations and conditions.

The user controllable braking system 114 enables a user to control and even halt descent from a support from which the user is descending.

The tip resistant system 200 operates to maintain a user in a desired static attitude, and having quick disconnect features that enable the user to quickly disconnect from the belay tether using only one hand and in difficult conditions.

As shown in FIGS. 2 and 3, the load attachment device 12 is mounted to an overhead support 14 and used to support a user U suspended from an automatic belay device 16 having a belay tether 16*a*. Because load attachment device 12 is shown in combination with the braking system 114, a distal end of the belay tether 16*a* is shown connected to a secondary overhead support 14*a*. In this regard, it will be appreciated that various support structures may be used, and the overhead support 14 and the secondary support 14*a* are provided only for the purpose of example. Further, it will be appreciated that the terminal end of the belay tether 16*a* may be connected to any support higher than the braking system 114.

Figure 4:
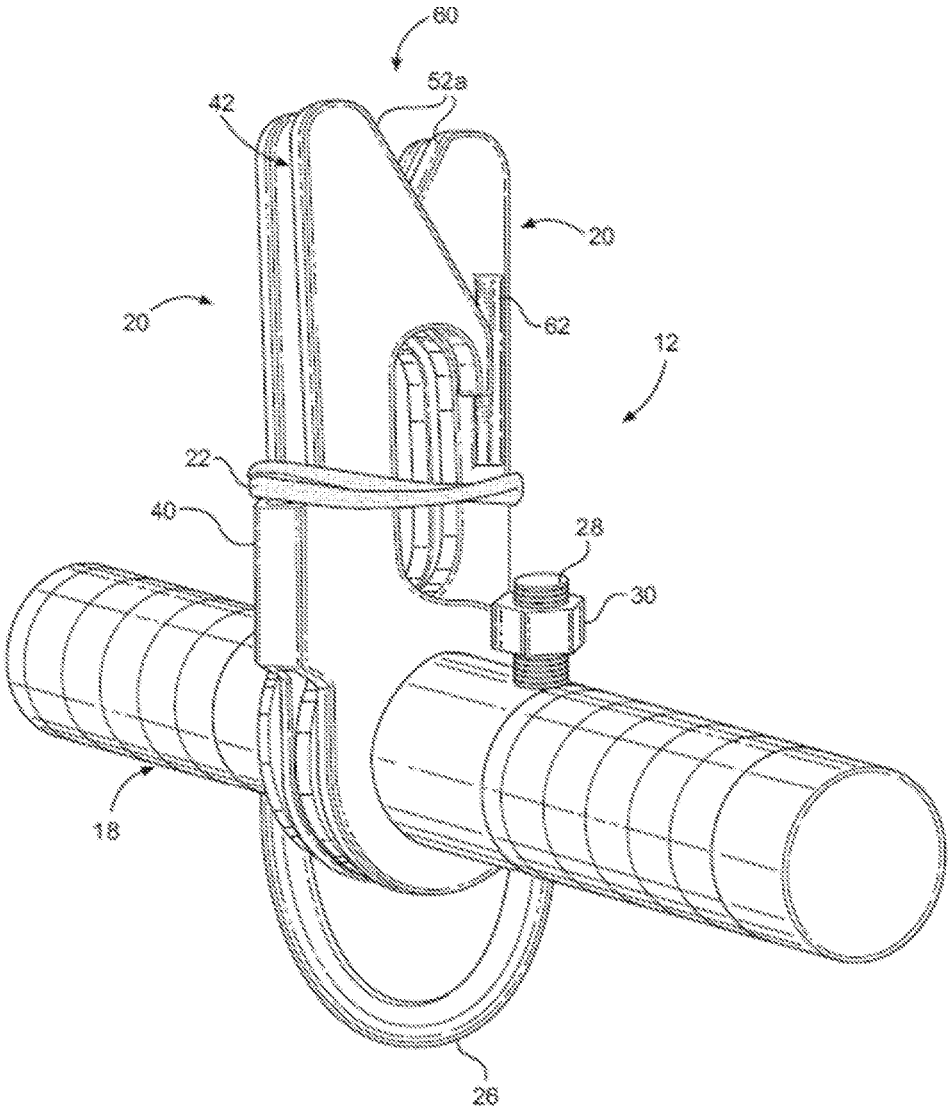
FIG. 4 shows a push locking load attachment device according to the invention and utilized as part of the user insertion system of FIGS. 2 and 3.
Figure 5:
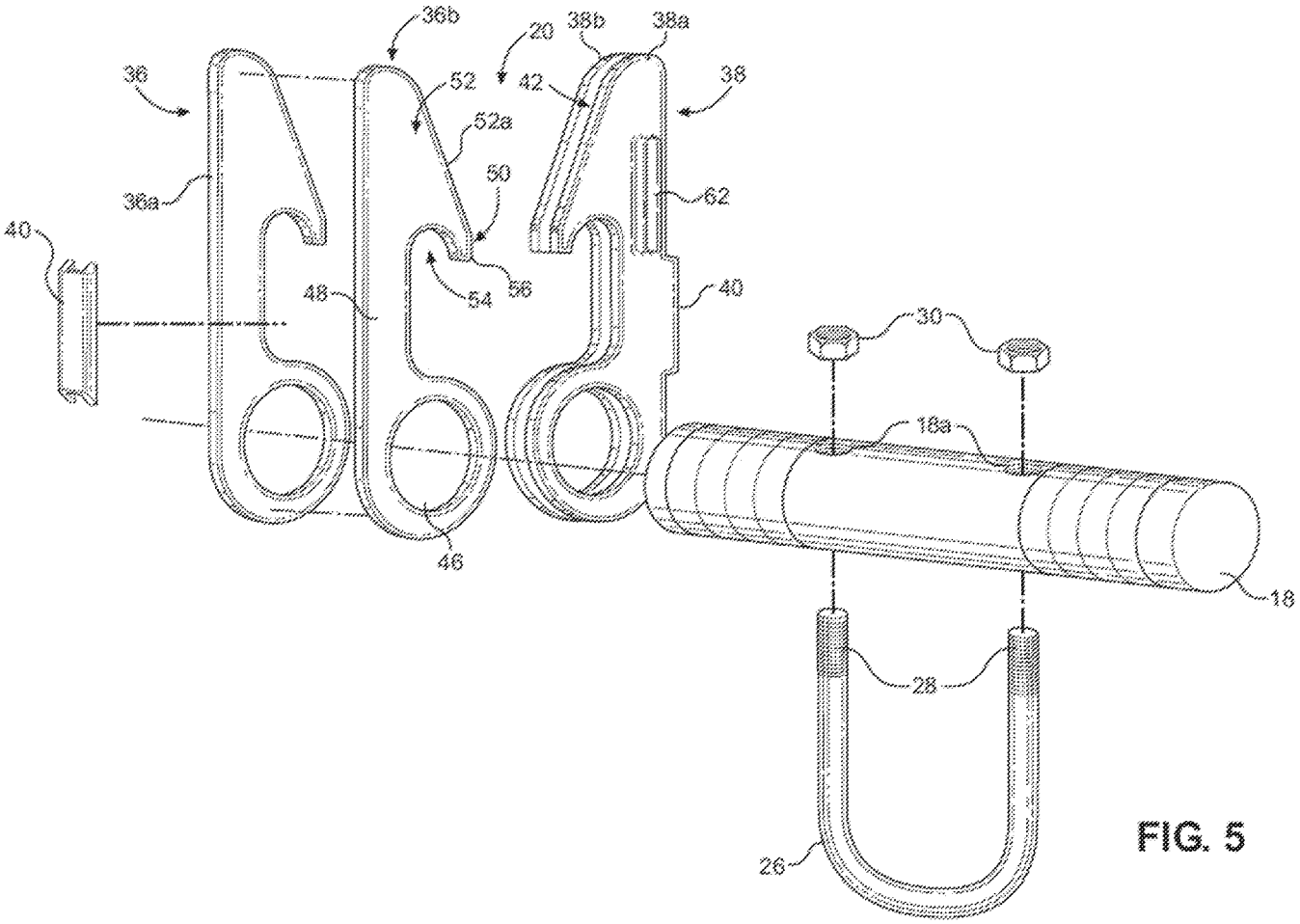
FIG. 5 is an exploded view of the push locking load attachment device of FIG. 4.

With reference to FIGS. 4 and 5, the push locking load attachment device 12 generally includes a hub 18, hook structure 20 mounted to the hub, and a biasing member 22 engaging the hook structure 20.

The hub 18 is provided as by an elongate bar or other elongated member, having a U-shaped load attachment bar 26, e.g. a belay attachment structure, mounted to it. The U-shaped load attachment bar 26 includes threaded ends 28 that extend through apertures 18*a* of the hub 18 on either side of the hook structures 20 and are secured in place by fasteners 30, e.g. threaded fasteners. Loads, such as the belay tether 16*a* and the user U shown in FIGS. 2 and 3, may be suspended from the push locking load attachment device 12 by connecting to the load attachment bar 26.

With reference to FIG. 5, the hook structure 20 includes two or more hooks, including a first hook 36 and a second hook 38. The hooks 36 and 38 are oppositely facing and laterally offset from one another, as depicted.

The first hook 36 or the second hook 38 may each be a single hook or may be made using multiple hook members. For example, as shown, the first hook 36 includes hook members 36*a* and 36*b*, and the second hook 38 includes hook members 38*a* and 38*b*. A rigid connector 40, e.g. a joining member, positions the hook members 36*a* and 36*b* in spaced apart relation to one another so that a gap 42 is formed between them. Another rigid connector 40 holds the hook members 38*a* and 38*b* in spaced apart relation to one another so that a gap 42 is also formed between them.

It is not required that both sets of the hook members be joined together by a rigid connector 40. One pair may be joined while the other pair of hook members remains unjoined such that the individual hook members of the unjoined pair of hook members are able to rotate freely with respect to one another. In certain cases, the rigid connector 40 is a weld that joins the hook members together while, at the same time, providing a space between the hooks. The pairs of hooks 36 and 38 are arranged in a meshed configuration where one of the hook members 36*a* or 36*b* of the hook 36 is inserted into the gap between the hook members 38*a* and 38*b* of the second hook 38. At the same time, one of the hook members 38*a* and 38*b* of the second hook 38 is inserted into the gap between the hook members 36*a* and 36*b*.

It will be appreciated that each of the hooks 36 and 38 may be made up of multiple hook members. For example, each of the hooks 36 and 38 may be provided by two, three, four, or more of the hook members, such as the hook members 36*a* and 36*b* and hook members 38*a* and 38*b*. In this regard, a load rating of the attachment device 12 may be determined by the number of hook members utilized for each of the hooks, and the load rating of the attachment device may be adjusted by adjusting the number of hook members utilized by each of the hooks.

Each of the hook members 36*a*, 36*b*, 38*a*, and 38*b* may be substantially identical in shape and can include a mount 46 rotatably positioned on the hub 18, a shank 48 extending away from the mount 46, and a tip 50 at a terminal end. A bend 52 having a sloping engagement surface 52*a*, e.g. elongate exterior sloped surface, is formed at the tip 50 and a hook surface 54 is formed opposite the shank and the sloping engagement surface 52*a*. The tip 50 is configured to define a projection 56 formed at the intersection of the hook surface 54 and the sloping engagement surface 52*a*.

Figure 6A:
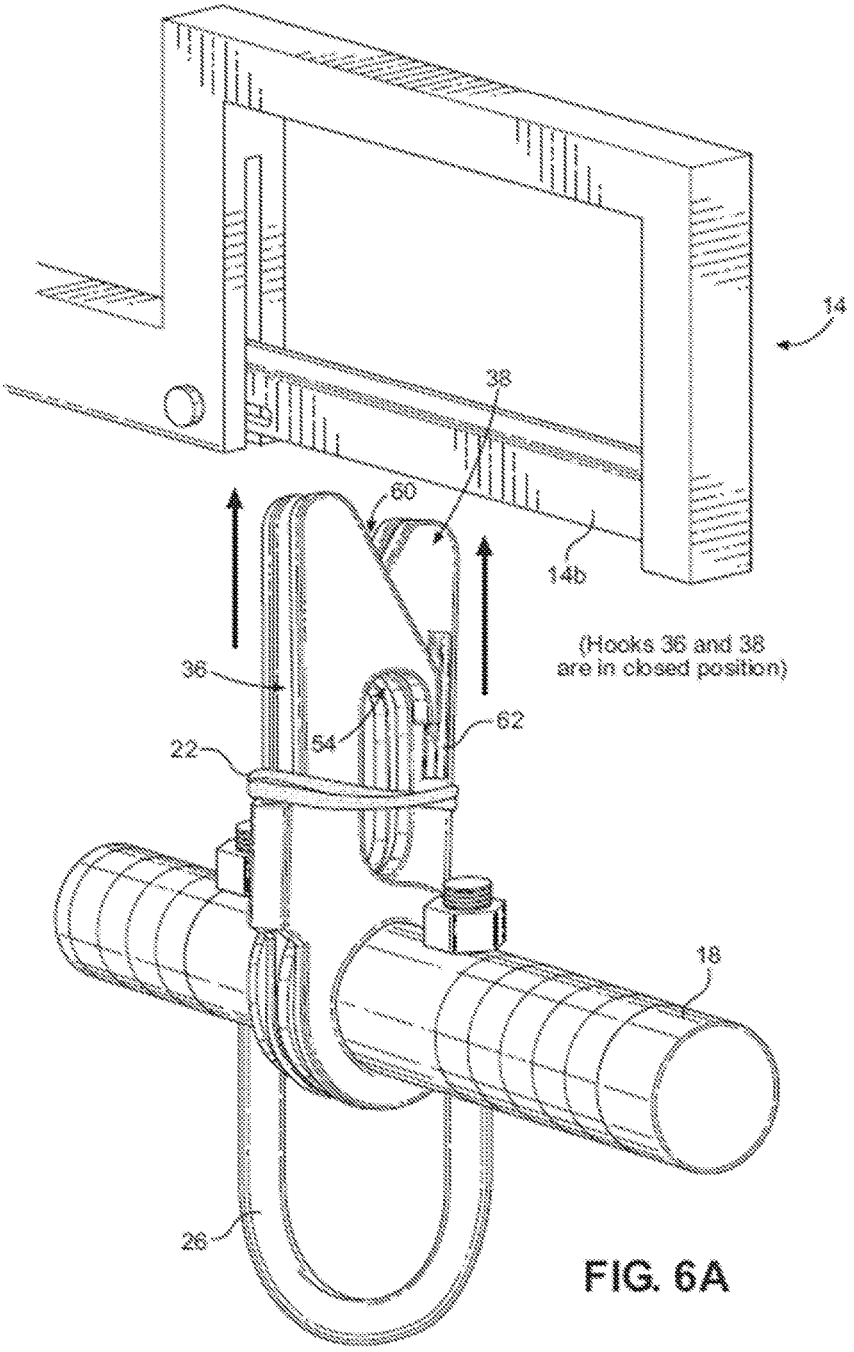
FIG. 6A-6C depict the push locking load attachment device of FIG. 4 engaging a support.
Figure 6B:
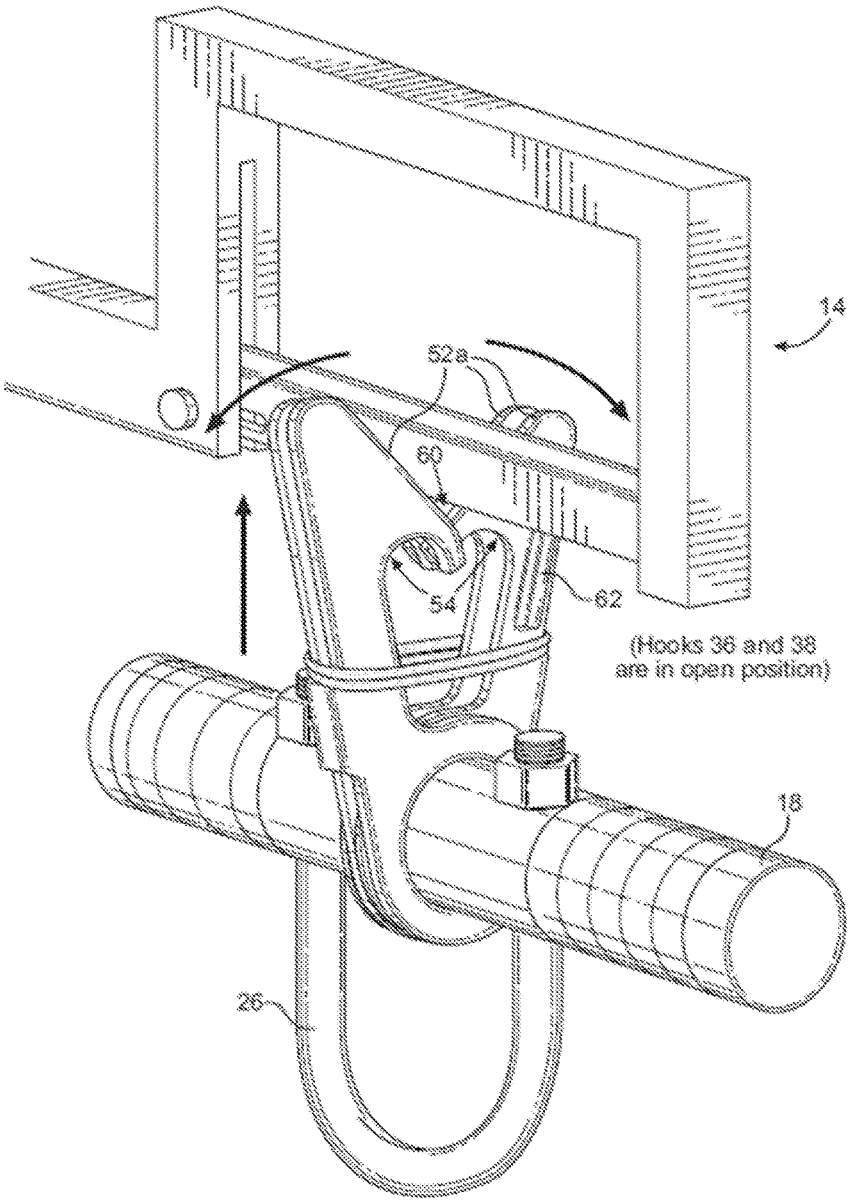
Figure 6C:
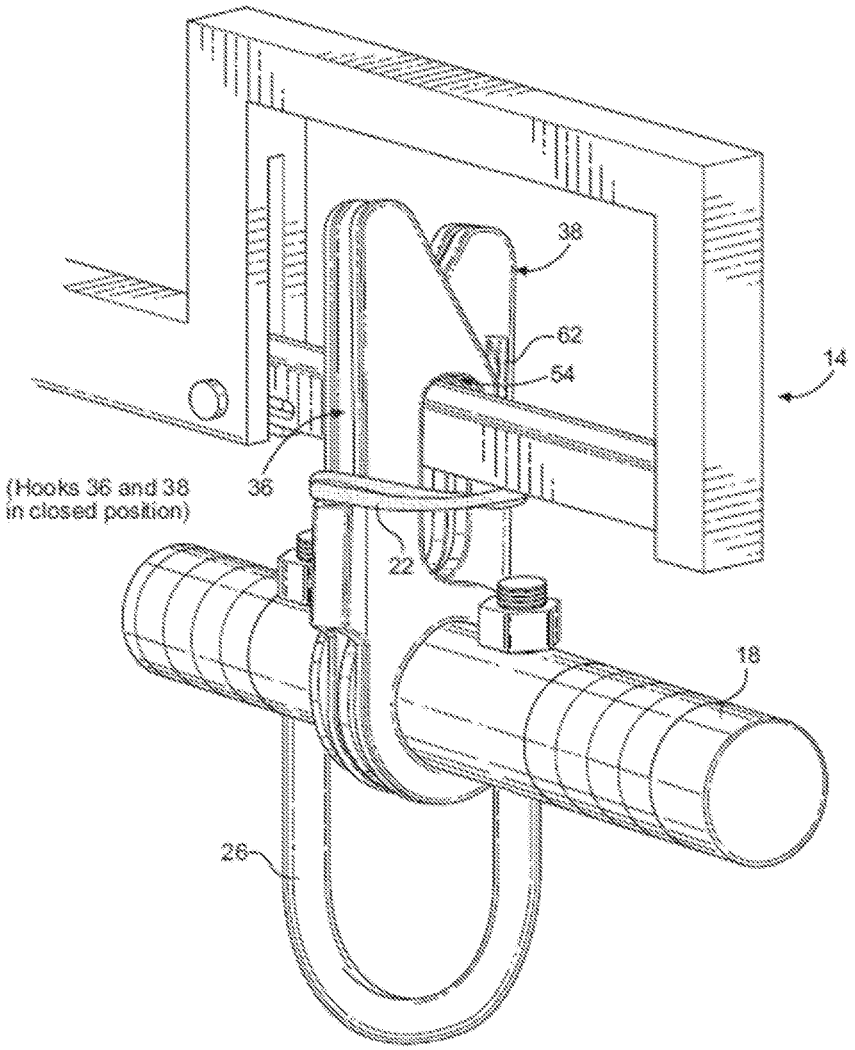

The hooks 36, 38 are rotatably mounted to the hub 18 in the meshed configuration discussed above and are configured to rotate between an open position and a closed position. FIGS. 6A and 6C represent the hooks 36 and 38 in the closed position, and FIG. 6B represents the hooks 36 and 38 in the open position.

Hook members 36*a*, 36*b* and 38*a*, 38*b* may be joined together by a joining member, such as the rigid connector 40, to rotate simultaneously with one another. This has the advantage of simplifying the rotating action and facilitating simultaneous engagement. The hooks 36, 38 are biased towards the closed position by the biasing member 22.

As shown, the biasing member 22 is an elastic band secured around the outside of the hooks 36, 38, and sized to cause the hooks 36, 38 to be automatically rotated to the closed position and firmly held in place. It will be appreciated that the biasing member 22 may be otherwise configured and provided as by springs, actuators, and other biasing members.

Due to the arrangement of the hooks 36 and 38, the sloping engagement surfaces 52*a* of the hooks 36 and 38 cooperate to define a V-shaped guide 60. One of the hooks 36 or 38 includes a rotation limiting member or stop 62, which limits the relative motion of the hooks 36 and 38 towards the closed position so that the sloping engagement surfaces 52*a* remain positioned to define the guide 60. For example, each of the hook members 38*a* and 38*b* preferably includes the stop 62.

The provision of the V-shaped guide 60 in particular facilitates one-handed installation of the attachment device 12 onto the support 14, as depicted in FIGS. 6A-6C. That is, the V-shaped guide 60 enables the attachment device 12 to be easily oriented so that the user may quickly attach the device 12 using only one hand by simply pressing the device 12 against the support 14 as explained herein.

The attachment device 12 is installable onto the support 14 by grasping the hub 18 with one hand and urging the V-shaped guide 60 against the support 14 and continuing to urge the exterior sloped surfaces 52*a* that define the guide 60 toward the support 14 with sufficient force to overcome the biasing member 22 so that the tips 50 of the hook members rotate away from one another to separate and define sufficient space therebetween for passage of the tips 50 of the hook members 36*a*, 36*b*, 38*a*, and 38*b* past the support 14, with the biasing member 22 urging the hook members to rotate toward one another after the hook members have passed the support 14 to maintain the attachment device 12 installed onto the support 14.

For example, as illustrated in FIGS. 6A-6C, the push locking load attachment device 12 is designed for quick engagement with the support 14. The support 14 may be of a wide variety of supports associated with or attached to structures such as aircraft, buildings, trees, and rocks. The support 14 as depicted is a fast rope insertion and extraction system (FRIES) bar of the type commonly used with military vertical lift aircraft (e.g., helicopters). The FRIES version of the support 14 has a disengageable bar 14*b* that facilitates unhooking of the device 12 following its use.

In FIG. 6A, the push locking load attachment device 12 is shown in the closed position and being moved upwards but prior to actually engaging the support 14.

In FIG. 6B, the push locking load attachment device 12 is continuing to be moved upwards. In this view, the support 14 has contacted the sloping engagement surfaces 52*a* of the hooks 36, 38 so that the V-shaped guide 60 defined thereby guides the device 12 for installation onto the support 14. As will be observed in FIG. 6B, the hooks 36 and 38 are in the process of being rotated from the closed position to the open position, against the force of the biasing member 22.

In FIG. 6C, the support 14 is securely captured by the hooks 36 and 38, and the hooks 36 and 38 have automatically rotated back to the closed position in order to retain the support 14.

After the hooks 36 and 38 rotate to the closed position, the support 14 is prevented from being removed from engagement with the hooks 36 and 38 until the hooks 36 and 38 are rotated to the open position. The hook surfaces 54 can be configured so that applying a force to the surfaces 54 will limit the hooks 36 and 38 from rotating with respect to one another once the device 12 is attached to the support 14. Therefore, applying a force to the hook surfaces 54 when the hooks 36 and 38 are in the closed position will not cause the hooks to rotate to the open position. This helps to prevent the support 14 from inadvertently becoming disengaged from the push locking load attachment device 12.

The projections 56 further reduce the chances that the support 14 is inadvertently disengaged from the push locking load attachment device 12. In the event that the hooks 36 and 38 begin to rotate to the open position, the projections 56 are designed to contact the support 14 and to halt the rotating motion of the hooks 36 and 38.

With reference now to FIGS. 7-11, the user controllable braking system 114 is configured to enable the user U to apply braking force for controlling descent. The braking system 14 is operatively connectable between the belay tether 16*a* and the user U, such as seen in FIG. 2.

The automatic belay device 16 is configured to feed out the belay tether 16*a* during descent of the user U from the support 14, with the distal end of the belay tether 16*a* connected to the secondary support 14*a*. The automatic belay device 16 may take the form of a variety of belay devices and may be a conventional belay configured to store the belay tether 16*a* on an internal reel and automatically feed out the belay tether 16*a* to descend the user at a generally constant rate. The belay tether 16*a* is desirably a flat webbing, but may be round such as a rope or cable or the like, or of other cross-sectional configurations.

Figure 7:
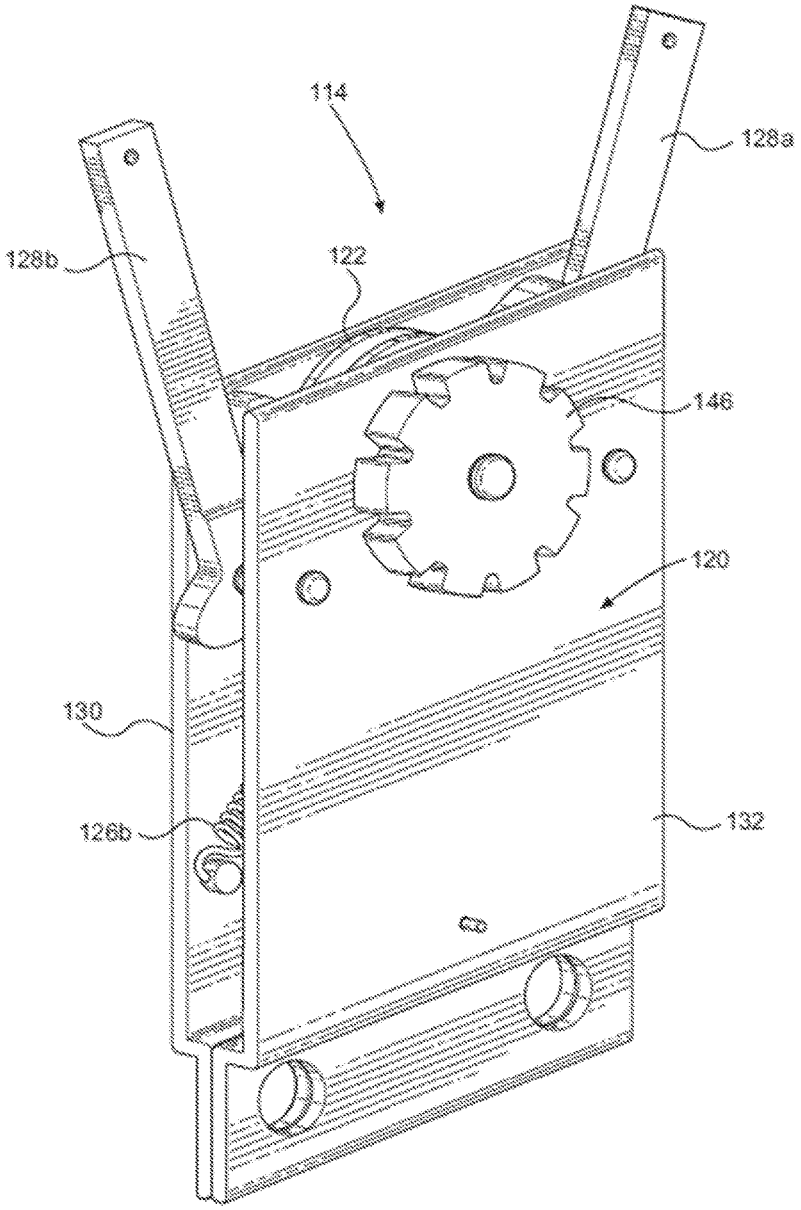
FIG. 7 is a perspective view of a braking system utilized in the user insertion system of FIGS. 2 and 3.
Figure 8:
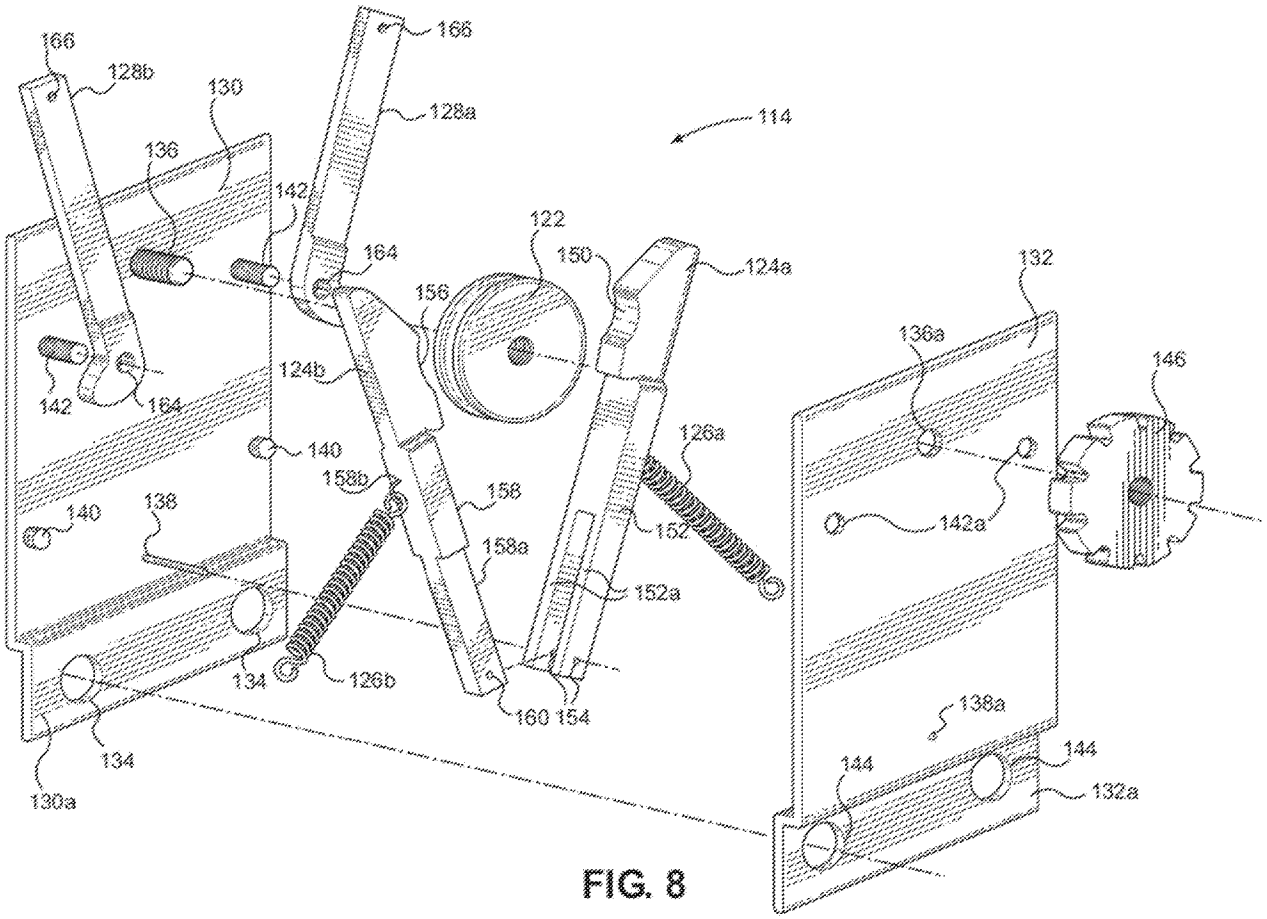
FIG. 8 is an exploded view of the braking system of FIG. 7.

The braking system 114 cooperates with the belay tether 16*a* and enables the user U to slow the speed of descent or to even halt descent even though the belay tether 16*a* continues to be fed from the automatic belay device 16. As shown in FIGS. 7 and 8, the braking system 114 includes a rigid body 120, a pulley 122, brake members 124*a* and 124*b*, bias members 126*a* and 126*b*, and levers 128*a* and 128*b*.

Figures 16A, 16B, 16C:
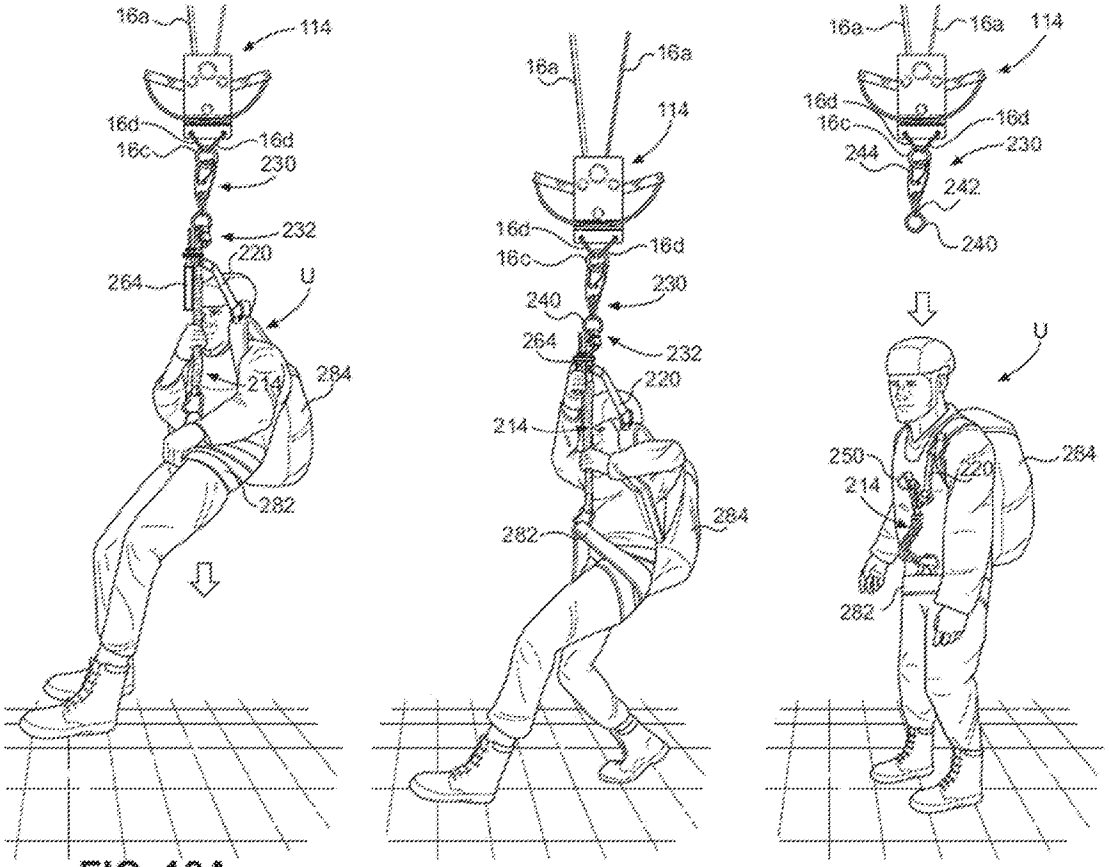
FIGS. 16A-16C depict landing of a user and disconnection of the user from a belay tether using the user insertion system of FIGS. 2 and 3.

The rigid body 120 provides a support for the pulley 122 and may be a single piece but is provided as by a pair of rigid plates 130 and 132 in the illustrated embodiment. The plate 130 is generally rectangular with a lower indented portion 130*a*. The indented portion 130*a* includes apertures 134 to facilitate attachment of the user U via a belay ring 16*c* to the braking system 114, such as shown in FIG. 2 and FIG. 16A, or by other attachment structure. The plate 30 includes a pulley mount 136, brake member mount 138, bias member mounts 140, and lever mounts 142.

The plate 132 preferably has the same shape as the plate 130 with a lower indented portion 132*a* and including apertures 144 corresponding to the apertures 134 of the plate 130. To assemble the rigid body 120 as made with the rigid plates 130 and 132, the indented portions 130*a* and 132*a* are placed in abutting relationship so that the remaining portions of the plates 130 and 312 are spaced apart to provide a housing into which the pulley 120, brake members 124*a* and 124*b*, bias members 126*a* and 126*b*, and levers 128 are located.

The plate 132 includes apertures 136*a*, 138*a*, and 142*a* which correspond in location to the mounts 136, 138, and 142, and receive the ends thereof. The mount 136 is desirably threaded at its end and extends past the plate 132 as assembled with the plate 130. An enlarged easy to grip nut 146 is threadably received by the mount 136 to secure the plates 130 and 132 together. The nut 146 is easily manipulated without tools to enable the plate 132 to be easily removed for installation of the belay tether 16 on the pulley 122, and then reinstalled.

The pulley 122 may be provided as by a grooved wheel or other conventional pulley structure rotatably positioned on the rigid body 120. The pulley 122 may be a static structure as well, and could be provided by a pin or the pulley mount 136. That is, the pulley 122 will be understood to be a structure that supports movement and change of direction of the belay tether 16*a*.

The brake member 124*a* is configured to have a brake surface 150 and a leg 152 depending from the brake surface 150. A lower portion of the leg 152 has a central portion thereof removed to provide spaced apart leg portions 152*a*. A connector 152*b* is provided on the leg 152 for connecting the bias member 126*a* to the leg 152. Aligned apertures 154 are provided through the leg portions 152*a* to receive the mount 138.

The brake member 124*b* is configured to have a brake surface 156 and a leg 158 depending from the brake surface 156. A lower portion of the leg 158 has a reduced dimension central portion 158*a* configured to be received by the spaced apart leg portions 152*a* of the leg 152. A connector 158*b* is provided on the leg 158 for connecting the bias member 126*b* to the leg 158. Aperture 160 is provided through the central portion 158*a* for receiving the mount 138.

The bias members 126*a* and 126*b* may be provided as by springs, rubber bands, or other elastic or elastomer members. The bias members 126*a* and 126*b* are mounted to the mounts 140 and the brake members 124*a* and 124*b*, respectively. The bias members 126*a* and 126*b* serve to bias the brake members 124*a* and 124*b* in a direction away from the pulley 122 so that braking force is not applied unless the user acts on the levers 128*a* and 128*b* to overcome the bias members 124*a* and 124*b* to enable the brake members 124*a* and 124*b* to be moved toward the pulley 122. As described more fully below in connection with FIGS. 9-11, the amount of braking force applied is proportional to the force applied by the user U to the levers 128*a* and 128*b*, and no braking force is applied until sufficient force is applied by the user U to extend the bias members 124*a* and 124*b*.

The lever 128*a* is an elongated rigid member having a lobed end 162 configured for interfacing with the brake member 124*a* for urging the brake member 124*a* toward the pulley 122 based upon the force exerted on the lever 128*a* by the user U. The lever 128*a* may be a straight bar or other simple geometry, but the provision of the lobed end 162 is preferred for smooth application of force to facilitate infinitesimal adjustment of the degree of braking force applied. The lever 128*a* includes an aperture 164 for receiving the lever mount 142 to pivotally mount the lever 128*a* to the plate 130. The opposite free end of the lever 128*a* includes an aperture 166 for attachment of a line 168 or the like thereto to facilitate the user U acting on the lever 128*a*, such as seen in FIGS. 2-3 and 9-11.

The lever 128*b* may be identical to the lever 128*a*, and is configured for interfacing with the brake member 124*b* for urging the brake member 124*b* toward the pulley 122 depending upon the force exerted on the lever 128*b* by the user U. The lever 128*b* likewise includes lobed end 162, aperture 164, and aperture 166.

Figure 9:
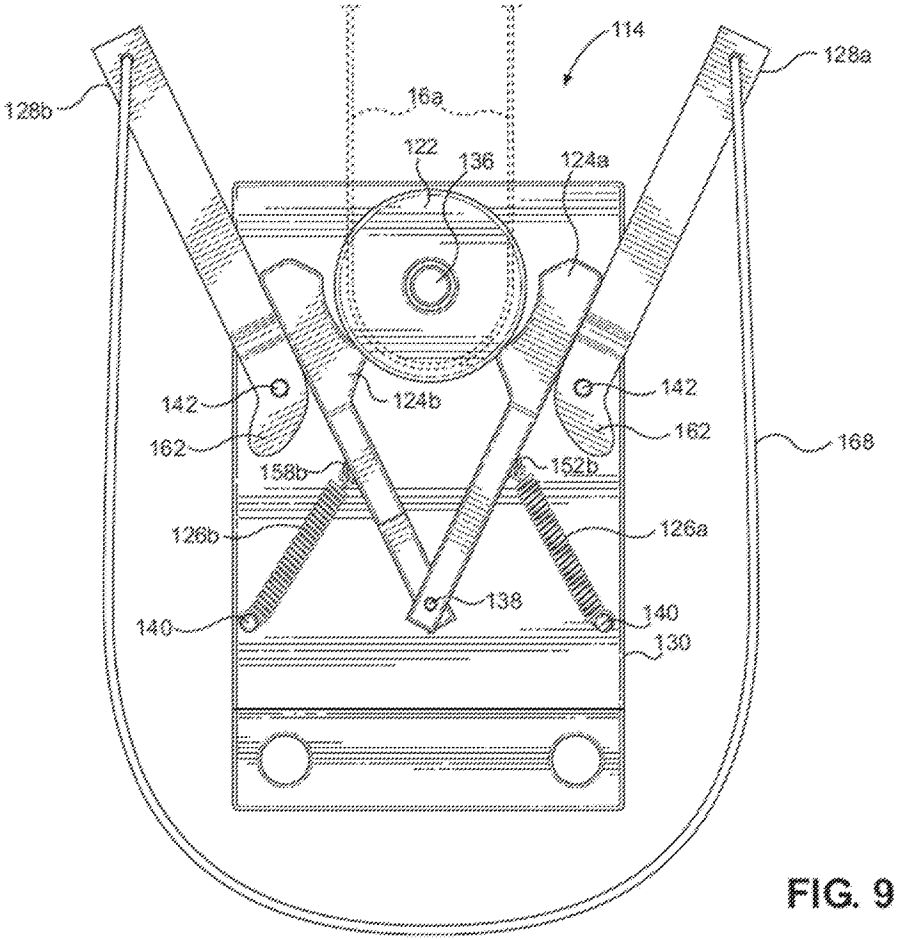
FIG. 9 depicts the braking system of FIG. 7 with a belay tether installed thereon and having brake members thereof oriented to apply no braking force.

The braking system 114 may be assembled by:

a. installing the pulley 122 onto the mount 126;
b. placing the reduced dimension central portion 158*a* of the leg 158 between the spaced apart leg portions 152*a* of the leg 152 so that the apertures 154 and 160 are aligned, and sliding the apertures 154 and 160 onto the mount 138 with the brake members 124*a* and 124*b* adjacent the edges of the pulley 122;
c. installing the bias members 126*a* and 126*b* on the mounts 140 and the connectors 152*b* and 158*b*, respectively;
d. installing the levers 128*a* and 128*b* on the lever mounts 142 with the lengths thereof parallel with the brake members 126*a* and 126*b* and opposite the pulley 122, as seen in FIG. 9; and
e. installing the plate 132 onto the plate 130 and securing in place using the nut 146.

To install the braking system 114 onto the belay tether 16*a*, the nut 146 is easily manipulated without tools to enable the plate 132 to be easily removed for installation of the belay tether 16*a* on the pulley 122, and then reinstalled.

Figure 10:
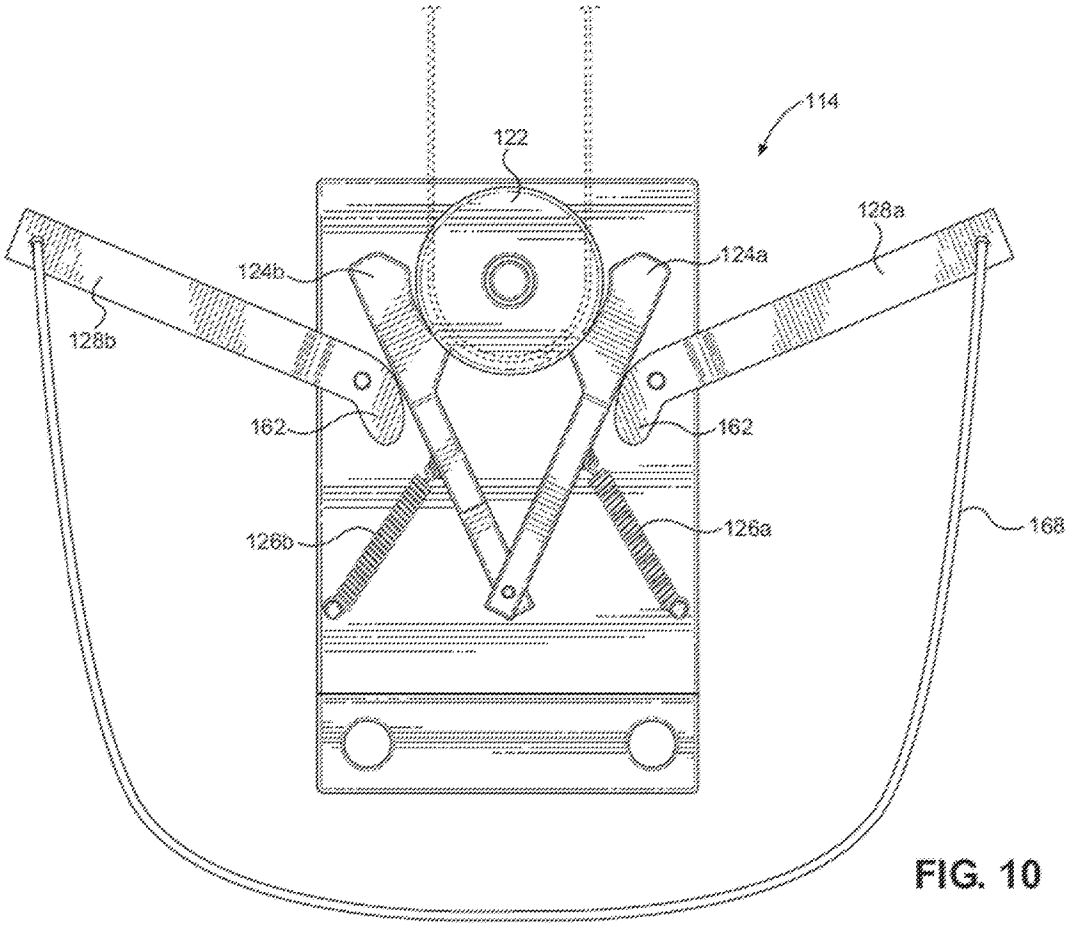
FIG. 10 depicts the braking system of FIG. 7 with a belay tether installed thereon and having brake members thereof oriented to apply a partial braking force to slow descent.
Figure 11:
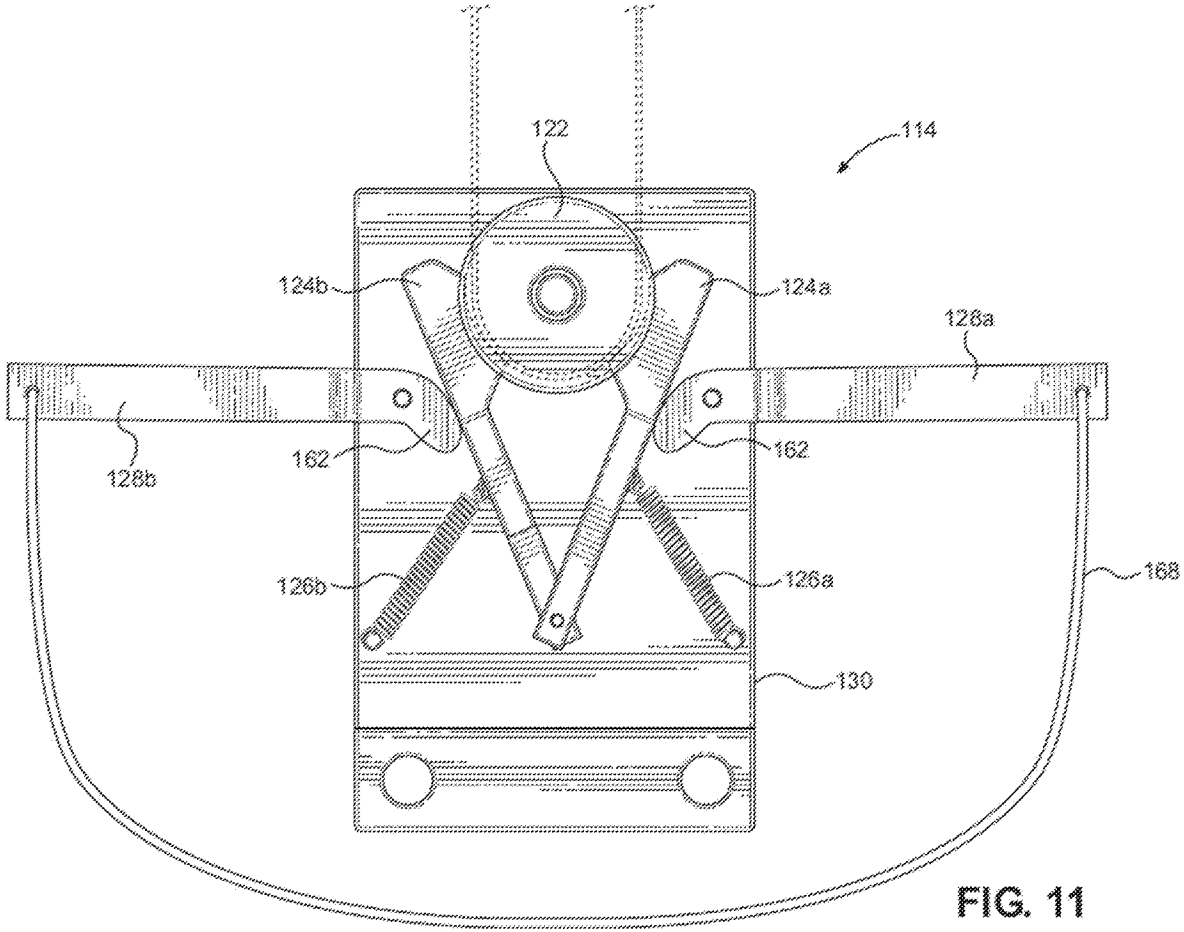
FIG. 11 depicts the braking system of FIG. 7 with a belay tether installed thereon and having brake members thereof oriented to apply a full braking force to halt descent.

With reference to FIGS. 9-11, it will be seen that operation of the levers 128*a* and 128*b* by the user U enables the user U to controllably bear the brake members 124*a* and 124*b* against the portion of the belay tether 16*a* positioned around the pulley 122 to provide a user controllable braking force for controlling descent of the user U.

FIG. 9 depicts the braking system 114 with the belay tether 16*a* installed thereon and having the brake members 124*a* and 124*b* oriented to apply no braking force. This corresponds to descent conditions in which the user U is not applying any force to the levers 128*a* and 128*b*.

FIG. 10 depicts the braking system 114 with the levers 128*a* and 128*b* oriented to correspond to application of a partial braking force. This corresponds to descent conditions in which the user U is applying a force to the levers 128*a* and 128*b* via the line 168 sufficient to bear the bias members 124*a* and 124*b* against the tether 16*a* to decrease the rate of travel of the tether 16*a* relative to the pulley 122 and slow the rate of descent. The user U may apply varying degrees of force to infinitesimally adjust the degree of force applied by the levers 128*a* and 128*b* to adjust the decrease of the rate of descent.

FIG. 11 depicts the braking system 114 with the levers 128*a* and 128*b* oriented to correspond to application of a full braking force. This corresponds to conditions in which the user U has fully extended the bias members 126*a* and 126*b* to fully bear the bias members 124*a* and 124*b* against the belay tether 16*a* and the pulley 122 to lock the belay tether 16*a* to the pulley 122 and stop descent.

Turning now to FIGS. 12-17D, the tip resistant system 200 will be shown and described. The tip resistant system 200 serves to maintain the user U in a desired static attitude A, characterized by the user U being maintained in a generally upright attitude, as depicted in FIGS. 2 and 3. The tip resistant system 200 is configured to be suitable for a variety of environments, such as those environments likely to be encountered by persons engaged in military, first responder, or recreational activities.

Figure 12:
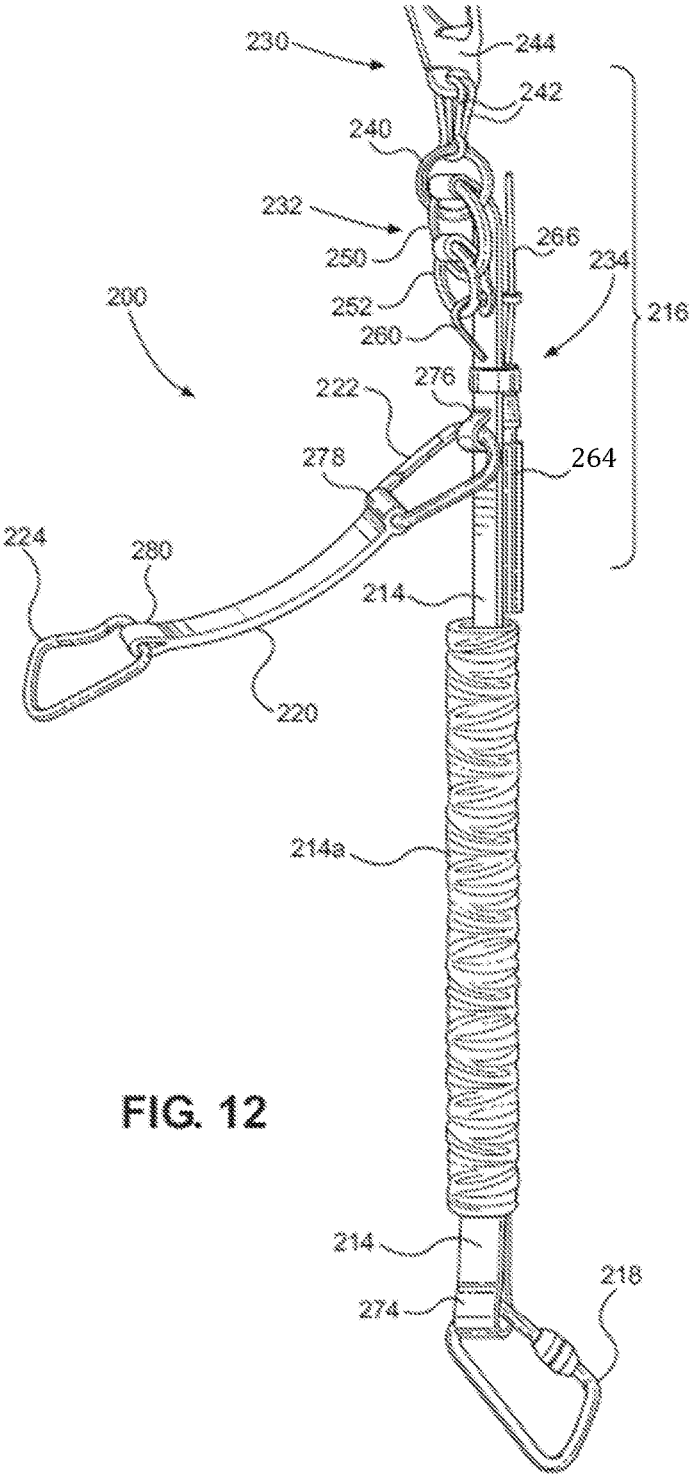
FIG. 12 shows a tip resistant system utilized in the user insertion system of FIGS. 2 and 3.
Figure 13:
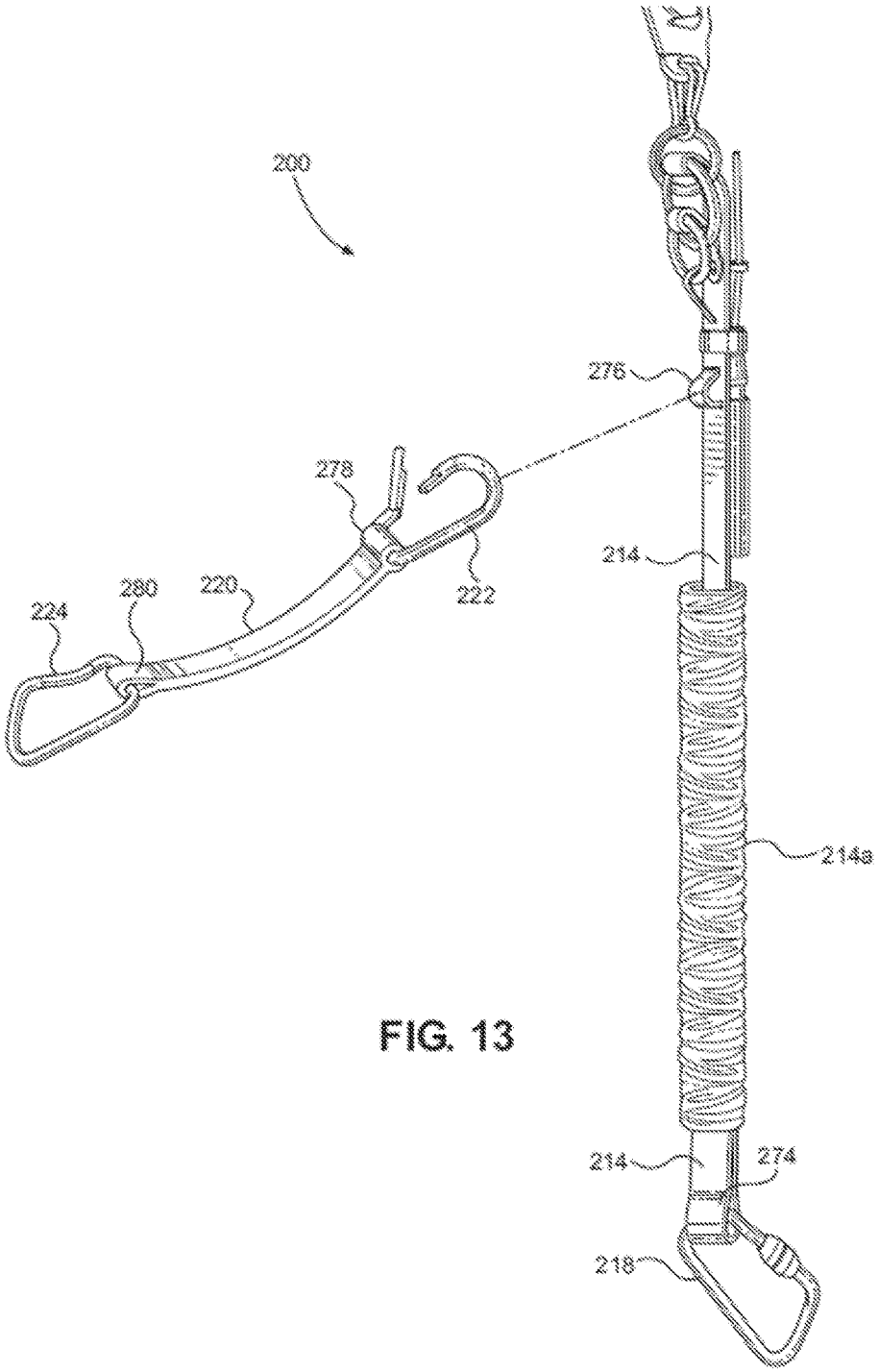
FIG. 13 is a partially exploded view of FIG. 12.

As seen in FIGS. 12 and 13, the tip resistant system 200 includes a user tether 214 configured to be connectable between the user U and the belay tether 16*a*, or the braking system 114. That is, if the braking system 114 is not used, the tip resistant 200 connects directly to the belay tether 16*a*. If the braking system 114 is used, the tip resistant system 200 connects to the braking system 114.

For example, in the illustrated embodiment, the belay ring 16*c* (FIG. 2, FIG. 16A) is attached to the bottom of the braking system 114 using rings 16*d* or other connectors to enable connection of the tip resistant system 200 to the braking system 114. Alternately, if the braking system 114 is not utilized, it will be understood that the belay ring 16*c* may be provided at the distal end of the belay tether 16*a*. Accordingly, the belay ring 16*c* or similar structure may be utilized to provide a connection point for the tip resistant system 200 to either the belay tether 16*a* or the braking system 114.

With further reference to FIGS. 12 and 13, the user tether 214 has a belay tether connector 216 adjacent one end of the user tether 214, and a user connector 218 adjacent an opposite end of the user tether 214. The tip resistant system 200 also includes an auxiliary tether 220 configured to be connectable between the user U and the user tether 214. The auxiliary tether 220 has a user tether connector 222 configured for connecting one end of the auxiliary tether 220 to the user tether 214, and an auxiliary user connector 224 located adjacent an end of the auxiliary tether 220 opposite the user tether connector 222.

Figure 14:
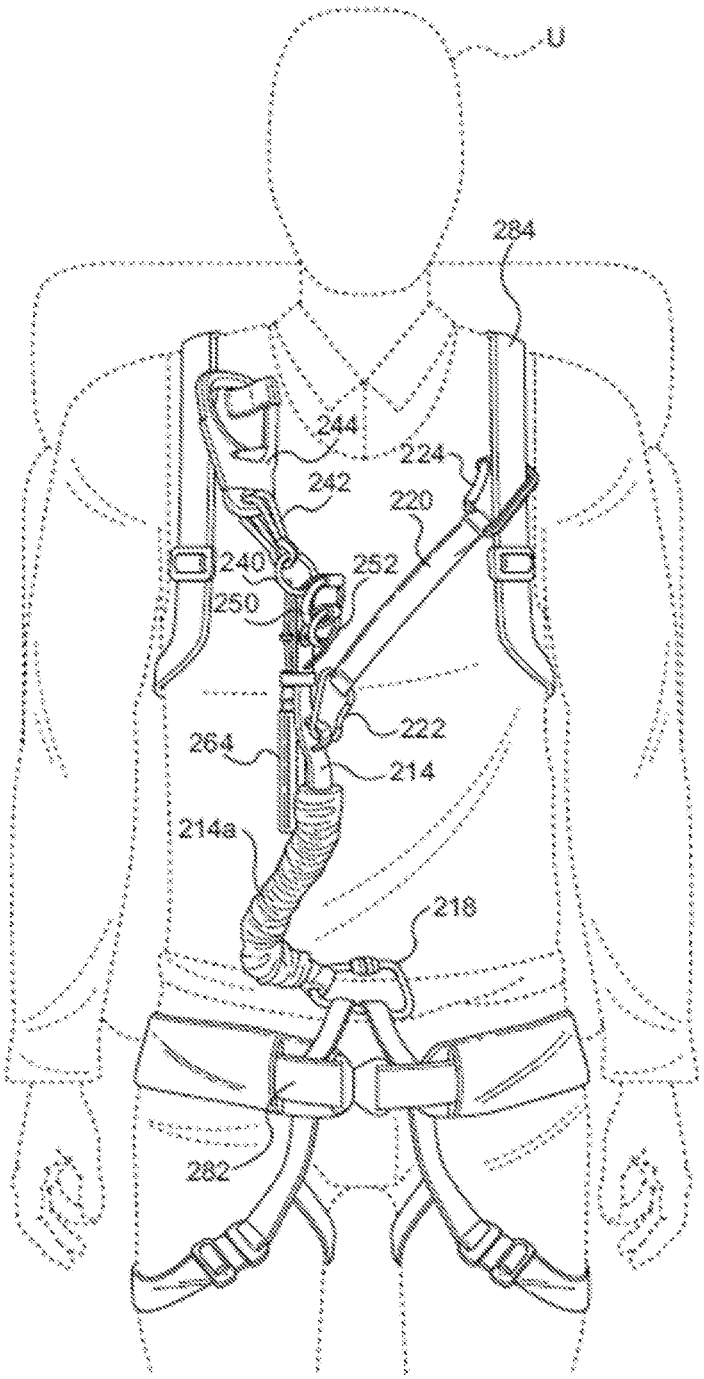
FIG. 14 shows a user wearing the tip resistant system of FIG. 11 as configured prior to connection to a belay tether.
Figure 15:
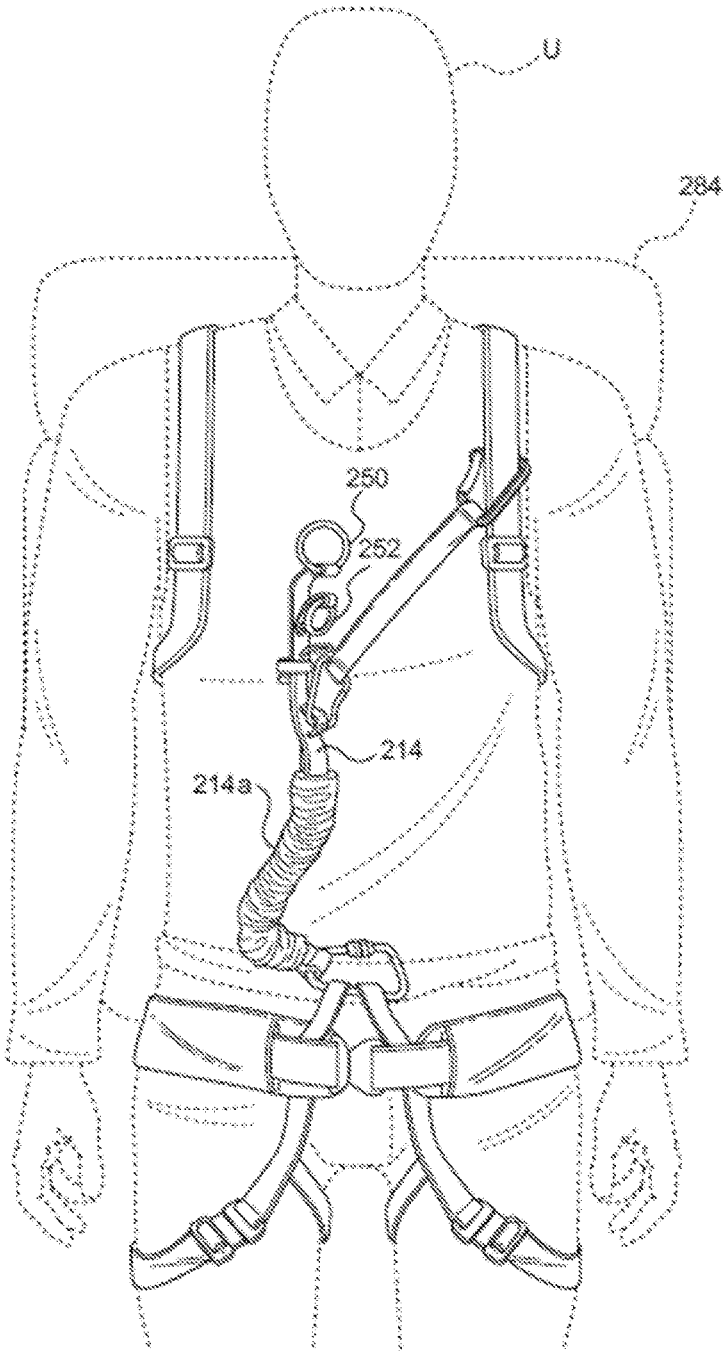
FIG. 15 shows a user wearing the tip resistant system of FIG. 12 as configured immediately after disconnection from a belay tether.

The user tether 214 preferably has a length of from about 15 inches to about 50 inches to fit the majority of users. The user tether 214 may be made of any sufficiently strong tether material, but in the illustrated embodiment, the user tether 214 is made of nylon strap material. An elastic member 214*a* can be connected to the user tether 214 to gather and compact the length of the user tether 214 when it is not tensioned. The compaction of the user tether 214 by the elastic member 214*a* facilitates storage of the tether 214 against the user U when the tip resistant system 200 is not connected to the belay ring 16*c*, such as seen in FIGS. 14 and 15.

As seen in FIG. 12, the belay tether connector 216 includes a removable connector 230 separable from the user tether 214, an integral connector 232 non-removably connected to the user tether 214, and a mechanical disconnect 234 operably associated with the removable connector 230 and the integral connector 232. Together, the integral connector 232 and the mechanical disconnect 234 as configured herein provide a desirable quick disconnect feature of the tip resistant system 200.

As described herein, integral connector 232 and the mechanical disconnect 234 of the belay tether connector 216 are configured to provide a quick disconnect feature that enables quick and easy connection to the belay ring 16*c* and also enables quick and easy disconnection from the belay ring 16. The quick disconnect feature is particularly desirable to enable the user U to quickly disconnect when using the invention in difficult conditions and environments. The quick disconnect feature enables the user U to disconnect from the belay ring 16*c* with limited engagement from the user, such as requiring the use of only one hand to accomplish disconnect.

Figure 17A:
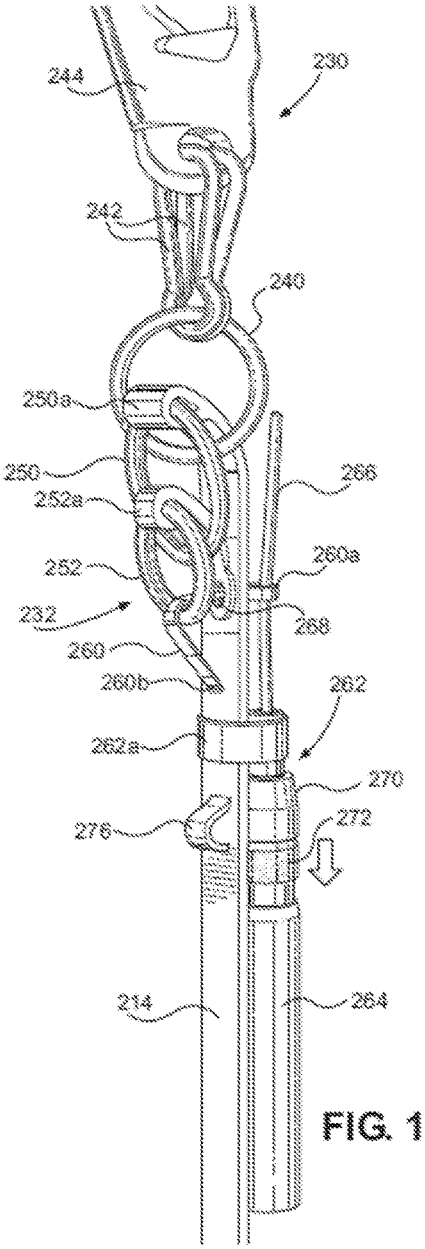
FIGS. 17A-17D show operation of a quick disconnect of the tip resistant system.

With reference to FIGS. 12 and 17A, the removable connector 230 facilitates quick connection to the belay ring 16*c* and includes a belay tether ring 240. The belay tether ring 240 can be coupled as by snap loops 242 to a quick release carabiner or snap hook 244 that can snap to the ring 212*a* of the belay ring 16*c*.

The integral connector 232 includes a pair of cooperating rings 250 and 252, as shown in detail in FIGS. 17A-17D. Each of the cooperating rings 250 and 252 is smaller in diameter than the belay tether ring 240 and is integrally connected to the user tether 214. The ring 252 is smaller than the ring 250 so as to be able to pass therethrough. The ring 250 is integrally connected to the end of the user tether 214 by a loop 250*a*. The ring 252 is integrally connected to the user tether 214 just below the ring 252 by a loop 252*a*.

The mechanical disconnect 234 includes a cord 260 operably associated with the cooperating rings 250 and 252, a lock member 262 fixedly coupled to the user tether 214 as by a band 262*a*, a handle 264 removably couplable to the lock member 262, and a relatively rigid cable 266 having one end fixed to the handle 264 and the opposite free end extending upwardly and positioned to be releasably connectable to the cord 260.

The cord 260 has a free end defining a loop 260*a* and an opposite end 260*b* affixed to the user tether 214. The loop 260*a* passes through an aperture 268 defined through the user tether 214. The handle 264 may be of molded plastic construction with the cable 266 being a nylon cord attached to the handle 264. For example, the cable 266 may be attached when molding of the handle 264. As described more fully below, the loop 260*a* of the cord 260 is passed through the aperture 268 of the user tether 214. The cable 266 of the handle 264 extends through and past the loop 260*a* to prevent the loop 260*a* from passing back through the aperture 268. Once the handle 264 is pulled by the user to activate the quick disconnect feature, the cable 266 travels downward with the handle 264 to withdraw the cable 266 from the loop 260*a*.

In a preferred embodiment, the handle 264 includes a spring-loaded collar 270 and lock bearings shown in phantom as represented by reference numeral 270*a* (FIG. 17C) and located within the inner circumference of the collar 270. For this handle configuration, the lock member 262 may be provided as by a cylinder 272 having a circumferential indent 272*a* (FIG. 17C) that cooperates with the lock bearings 270*a* and the spring-loaded collar 270 to releasably lock the handle 264 to the lock member 262.

The user connector 18 may be provided as by a locking carabiner or like structure. The user connector 218 may be connected to the user tether 214 as by a loop 274 sewn or otherwise formed on the user tether 214 (FIG. 12).

The auxiliary tether 220 may be made of any sufficiently strong tether material, but in the illustrated embodiment is made of nylon strap material. The auxiliary tether 220 has a length less than the length of the user tether 214, and preferably from about 5 inches to about 35 inches. Thus, the ratio of the length of the user tether to the length of the equipment tether preferably ranges from about 1.4 to about 3.0.

The user tether connector 222 may be provided as by a quick release carabiner or like structure. The user tether connector 222 may be connected to the user tether 214 as by a loop 276 formed on the user tether 214 adjacent the belay tether connector 216. In this regard, a loop 278 or the like receiving structure is desirably formed on the auxiliary tether 220 for locating the user tether connector 222 onto the auxiliary tether 220.

The auxiliary user connector 224 may each be provided as by a quick release carabiner or like structure. The auxiliary user connector 224 may be connected to the auxiliary tether 220 as by a loop 280 formed on the auxiliary tether 220.

FIGS. 2, 3, 12 and FIG. 16A each show the user U suspended from the belay tether 16*a*, with the tip resistant system 200 maintaining the user U in the desired static attitude A, characterized by the user U being maintained in a generally upright attitude. In the illustrated embodiment, the user U wears a body harness 282 and is wearing or carrying equipment 284 about an upper body portion of the user. The body harness 282 may be of a variety of conventional harness, such as waist harnesses, hip harnesses, and the like. The equipment 284 may be a backpack, body armor, tools, weaponry, or a variety of other equipment a user may carry or wear depending on the activity in which the user U is engaged.

In the illustrated embodiment, the user tether 214 connects to the body harness 282 via the user connector 218, and the auxiliary tether 220 connects to the equipment 284, such as the strap of a backpack or other equipment, via auxiliary user connector 224. Absent the presence of auxiliary tether 220 connected between the user tether 214 and the equipment 284, the user U would not be able to maintain the upright attitude without the use of one or both hands and considerable effort. As depicted in FIG. 2, the use of the tip resistant system 200 having the auxiliary tether 220 serves to maintain the user U in the desired attitude without the use of any hands.

FIG. 14 shows the user U outfitted with the tip resistant system 200 prior to connection to the belay ring 16*c*. As configured, the tip resistant system 200 may be worn by the user U in advance of connection to the belay ring 16*c*, and is configured to permit quick and easy connection to the belay ring 16*c*. For example, the user U may install the tip resistant system 200 by attaching the user connector 218 to the body harness 282, and connecting the auxiliary user connector 224 to the equipment 284. If desired, and as shown in FIG. 14, the snap hook 244 may be attached to a loop on clothing of the user U or to the equipment 284 or the like to maintain the snap hook 244 in an easily accessible location, and to inhibit movement of the snap hook 244 when not connected to the belay ring 16*c*. The elastic member 214*a* can be seen in FIG. 14 serving to compact the length of the untensioned user tether 214.

As outfitted in FIG. 14, the user U need only disconnect the snap hook 244 from its storage position and connect the snap hook 244 to the belay tether ring 240 to connect to the belay ring 16*c*. The user U is then ready to be acted on by the belay ring 16*c* to raise or lower the user U.

FIG. 15 and its corresponding FIG. 16C each show the user U after disconnection from the belay ring 16*c*. As will be observed, when the user U disconnects from the belay ring 16*c*, the removable connector 230 remains with the belay ring 16*c*. The removable connector 230 and the mechanical disconnect 234 may be reinstalled to render the tip resistant system 200 again ready for use.

Returning to FIGS. 16A-16C, the operation of the tip resistant system 200 during descent (or ascent) of the user U via the belay tether 16*a*, landing, and disconnection from the belay tether 16*a* is represented. As seen in FIG. 16A, the tip resistant system 200 operates to maintain the user U in a desired upright attitude. The upright attitude of the user U facilitates stable foot and leg positioning of the user U as the user lands on the ground or other landing site and releases the removable connector 230 from the user tether 214 (FIG. 16B). FIG. 16C represents that the user U has landed and released from the belay tether 16*a*; and has done so in a manner such that the user U has remained in a desired upright attitude for the duration of the belay, landing and release events. It has been observed that use of the tip resistant system 200 advantageously serves to reduce undesirable landing events, such as falling and landing otherwise than on the feet in an upright attitude.

With reference to FIGS. 17A-17D, operation of the quick disconnect features of the tip resistant system 200 are illustrated. As seen, the quick disconnect features enable the user to quickly disconnect from the belay ring 16*c* with limited engagement by the user U. In the illustrated embodiment, the user U can employ the use of only one hand to accomplish disconnect. All of the activities of FIGS. 17A-17D may be accomplished by the user utilizing only one hand.

Figure 17B:
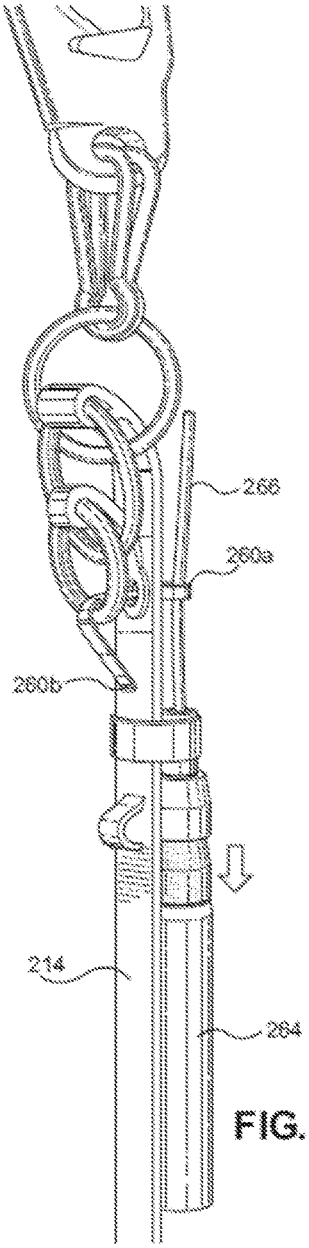

FIG. 17A corresponds to FIG. 16B, wherein the user U is activating the quick disconnect features of the tip resistant system 200. The arrow represents the user manipulating the spring-loaded collar 270 to free the lock bearings 270*a* from the indent 272*a* of the cylinder 272. Then, as seen in FIG. 17B, the user may pull down on the now unlocked handle 264 as represented by the arrow.

Figure 17C:
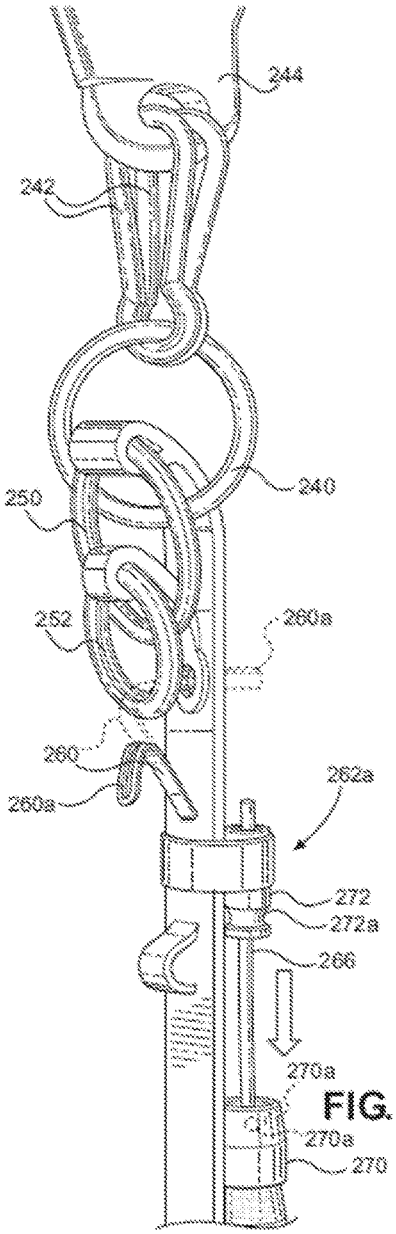
Figure 17D:
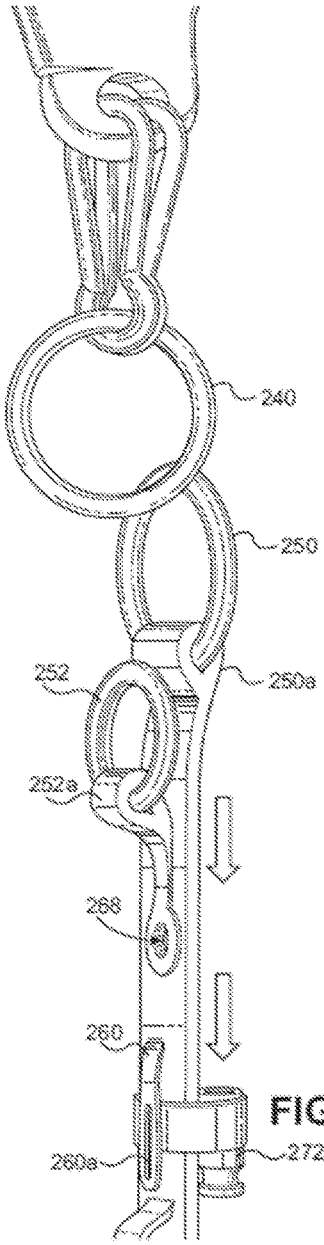

Moving to FIG. 17C, as the handle 264 is pulled down by the user, the cable 266 is disengaged from the cord 260, which enables the loop 260*a* to pass back through the aperture 268 of the user tether 214. As will be appreciated, the body weight of the user U and the weight of the equipment 284 exerts a downward force on the user tether 214. This downward force on the user tether 214 serves to pull the rings 250 and 252 downward, also enabling the loop 260*a* to pass back through the aperture 268 once the cable 266 is freed from the loop 260*a*. Once the loop 260*a* passes back through the aperture 268, the cord 260 disengages from the ring 252, freeing the ring 252. As a result of the ring 252 being freed, and as represented by FIG. 17D, the ring 252 can pass through the ring 250, which frees the ring 250 to pass through the ring 240 such that the user tether 214 is released from the belay ring 16*c*. In this regard, it will be appreciated that the scenario shown in FIG. 16C immediately follows the disconnection activity of FIG. 17D.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A user insertion system, comprising:

(a) a belay tether connectable to a support and configurable for descending a user;

(b) a tip resistant system, comprising: a user tether having a first length and configured to be connectable between the user and the belay tether, the user tether having a belay tether connector adjacent one end of the user tether, and a user connector adjacent an opposite end of the user tether, and an auxiliary tether having a second length less than the first length of the user tether and configured to be connectable between the user and the user tether, the auxiliary tether including: a user tether connector located adjacent a first end of the auxiliary tether, and an auxiliary user connector located adjacent a second end of the auxiliary tether opposite the user tether connector, wherein, during use of the tip resistant system by the user, the tip resistant system operates to maintain a user in a desired static attitude; and (c) a braking device connectable between the belay tether and the user, comprising: a rigid body configured to be connectable between the user and the belay tether, a pulley positioned on the rigid body and configured for receiving the belay tether when the braking system is in use, a first brake member yieldably positioned adjacent the pulley a first brake bias member operatively associated with the first brake member to bias the first brake member away from the pulley, and a lever pivotally connected to the rigid body and operable by the user to bear against the first brake member to controllably overcome the first brake bias member and controllably bear the first brake member toward the pulley, wherein the belay tether connector of the tip resistant system comprises a removable connector separable from the user tether, an integral connector non-removably connected to the user tether, and a mechanical disconnect operably associated with the removable connector and the integral connector.

2. The system of claim 1, wherein the user connector of the user tether is configured to be connectable to a body harness worn by the user.

3. The system of claim 1, wherein the auxiliary user connector of the auxiliary tether is configured to be connectable to equipment worn about an upper body portion of the user.

4. The system of claim 1, wherein the desired static attitude comprises an attitude wherein a head portion of the user is maintained at an upright location adjacent the belay tether connector.

5. The system of claim 1, wherein the pulley is rotatably positioned on the rigid body.

6. The system of claim 1, wherein the braking device further comprises a second brake member yieldably positioned adjacent the pulley, a second brake bias member operatively associated with the second brake member to bias the second brake member away from the pulley, and a second lever pivotally connected to the rigid body and operable to bear against the second brake member to controllably overcome the second brake bias member and controllably bear the second brake member against a portion of the belay tether.

7. The system of claim 1, wherein the first brake bias member comprises a spring or an elastomer.

8. A user insertion system, comprising:

(a) a belay tether connectable to a support and configurable for descending a user;

(b) a tip resistant system, comprising: a user tether having a first length and configured to be connectable between the user and the belay tether, the user tether having a belay tether connector adjacent one end of the user tether, and a user connector adjacent an opposite end of the user tether, and an auxiliary tether having a second length less than the first length of the user tether and configured to be connectable between the user and the user tether, the auxiliary tether including: a user tether connector located adjacent a first end of the auxiliary tether, and an auxiliary user connector located adjacent a second end of the auxiliary tether opposite the user tether connector, wherein, during use of the tip resistant system by the user, the tip resistant system operates to maintain a user in a desired static attitude; and (c) a braking device connectable between the belay tether and the user, comprising: a rigid body configured to be connectable between the user and the belay tether, a pulley positioned on the rigid body and configured for receiving the belay tether when the braking system is in use, a first brake member yieldably positioned adjacent the pulley a first brake bias member operatively associated with the first brake member to bias the first brake member away from the pulley, and a lever pivotally connected to the rigid body and operable by the user to bear against the first brake member to controllably overcome the first brake bias member and controllably bear the first brake member toward the pulley, further comprising a quick disconnect configured to releasably connect the user tether to the belay tether, the quick disconnect comprising a pair of cooperating rings integrally connected to the user tether, one of the cooperating rings being smaller than the other and passable therethrough, a cord associated with the cooperating rings, a lock member fixedly coupled to the user tether, a handle removably couplable to the lock member, and a cable fixed to the handle and releasably connectable to the cord.

9. A user insertion system, comprising:

(a) a belay tether connectable to a support and configurable for descending a user;

(b) an attachment device installable onto the support between the support and the belay tether, the attachment device comprising: a pair hooks rotatably mounted to the support so as to be oppositely facing and laterally offset from one another, a stop defined on one of the hooks and located so that the other one of the hooks is prevented from rotating past the stop by contact with the stop, and a biasing member operatively associated with the hooks for urging the hooks to rotate toward one another and until engaging the stop, which limits rotation of the hooks to maintain the hooks relative to one another to facilitate installation of the attachment device onto the support;

(c) a user braking device connectable between the belay tether and the user, comprising: a rigid body configured to be connectable between the user and the belay tether, a pulley positioned on the rigid body and configured for receiving the belay tether when the braking system is in use, a brake member yieldably positioned adjacent the pulley, a brake bias member operatively associated with the brake member to bias the brake member away from the pulley, and a lever pivotally connected to the rigid body and operable by the user to bear against the brake member to controllably overcome the first bias member and controllably bear the brake member toward the pulley; and (d) a tip resistant system, comprising: a user tether having a first length and configured to be connectable between the user and the belay tether, the user tether having a belay tether connector adjacent one end of the user tether, and a user connector adjacent an opposite end of the user tether, and an auxiliary tether having a second length less than the first length of the user tether and configured to be connectable between the user and the user tether, the auxiliary tether including: a user tether connector located adjacent a first end of the auxiliary tether, and an auxiliary user connector located adjacent a second end of the auxiliary tether opposite the user tether connector, wherein, during use of the tip resistant system by the user, the tip resistant system operates to maintain a user in a desired static attitude.

* * * * *